US011203206B2

(12) United States Patent
Arakane

(10) Patent No.: US 11,203,206 B2
(45) Date of Patent: Dec. 21, 2021

(54) IMAGE RECORDING APPARATUS

(71) Applicant: Brother Kogyo Kabushiki Kaisha, Nagoya (JP)

(72) Inventor: Satoru Arakane, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/830,713

(22) Filed: Mar. 26, 2020

(65) Prior Publication Data

US 2020/0307247 A1 Oct. 1, 2020

(30) Foreign Application Priority Data

Mar. 27, 2019 (JP) ..... JP2019-059751

(51) Int. Cl.
*B41J 2/21* (2006.01)
*B41J 2/045* (2006.01)
*B41J 2/165* (2006.01)

(52) U.S. Cl.
CPC ..... *B41J 2/2142* (2013.01); *B41J 2/0451* (2013.01); *B41J 2/16505* (2013.01); *B41J 2/2139* (2013.01)

(58) Field of Classification Search
CPC .... B41J 2/2142; B41J 2/2139; B41J 2/17596; B41J 2/0451; B41J 2/2146; B41J 2/16505
See application file for complete search history.

(56) References Cited

U.S. PATENT DOCUMENTS

| | | | | |
|---|---|---|---|---|
| 6,659,580 | B2 | 12/2003 | Horikoshi | |
| 2003/0043227 | A1 | 3/2003 | Horikoshi | |
| 2007/0139461 | A1 | 6/2007 | Izuo | |
| 2008/0106573 | A1 * | 5/2008 | Chang | B41J 25/003 347/41 |
| 2014/0300657 | A1 | 10/2014 | Ike | |
| 2016/0243862 | A1 | 8/2016 | Yoshida | |

FOREIGN PATENT DOCUMENTS

| | | | |
|---|---|---|---|
| JP | 2000-094662 | A | 4/2000 |
| JP | 2008-093982 | A | 4/2008 |
| JP | 4929699 | B2 | 5/2012 |
| JP | 2016-153182 | A | 8/2016 |
| JP | 2017-177423 | A | 10/2017 |
| JP | 6231759 | B2 | 11/2017 |

* cited by examiner

*Primary Examiner* — Justin Seo
(74) *Attorney, Agent, or Firm* — Banner & Witcoff, Ltd.

(57) ABSTRACT

There is provided an image recording apparatus, including: a conveyer; a recording head; a carriage; a signal output circuit; and a controller. When recording is performed by a multi-pass recording mode, when the number of defective-discharge nozzles is less than a predefined value, when a discharge-defective nozzle, in which a dot recording ratio using a first mask data is equal to or more than a threshold value, is included in nozzles, and when a discharge-defective nozzle, in which a dot recording ratio using a second mask data is equal to or more than the threshold value, is not included in the nozzles, the controller sets the second mask data as a used mask data and performs recording without a suction purge. In other cases, the controller sets the first mask data as the used mask data and performs a purge process before recording as needed.

22 Claims, 21 Drawing Sheets

Fig. 15

| INK COLORS | ANY OTHER COLORS THAN YELLOW | YELLOW |
|---|---|---|
| Rt | Rt1 | Rt2(>Rt1) |

IMAGE RECORDING APPARATUS

CROSS REFERENCE TO RELATED APPLICATION

The present application claims priority from Japanese Patent Application No. 2019-059751 filed on Mar. 27, 2019, the disclosure of which is incorporated herein by reference in its entirety.

BACKGROUND

Field of the Invention

The present disclosure relates to an image recording apparatus configured to record an image by discharging ink from nozzles.

Description of the Related Art

As an exemplary image recording apparatus that records an image by discharging ink from nozzles, there are known multiple printers that perform recording by discharging ink from nozzles.

In the first publicly known printer, a discharge state for each nozzle is checked and a maintenance operation is performed when the check result satisfies predefined conditions.

In the second publicly known printer, printing is performed by repeating a recording pass and a conveyance process. In the recording pass, ink is discharged from a printing head on a sheet during movement in a main scanning direction of the printing head. In the conveyance process, a conveyer is used to convey the sheet in a conveyance direction. In another publicly known printer, so-called multi-pass recording is performed. In the multi-pass recording, two band areas of the sheet where an image is recorded by two continuous recording passes partially overlap with each other in the conveyance direction. Then, different portions of dots formed in a partial area where the two band areas overlap with each other are printed in the two recording passes. In order to perform such recording, a dot recording ratio is set for each nozzle in the second publicly known printer.

SUMMARY

For example, like the first publicly known printer, when an instruction for recording an image is input, the discharge state may be checked for each nozzle. In that case, when the above conditions are not satisfied, recording is performed as it is without the maintenance operation. When the above conditions are satisfied, recording is performed after the maintenance operation. When the multi-pass recording is performed like the second publicly known printer, when the above conditions are satisfied, and when recording is performed after the maintenance operation is performed uniformly, a time after the recording instruction is input until the image recording is completed is lengthened. On the other hand, the image quality of an image to be recorded may be decreased when the above conditions are satisfied, and when recording is performed as it is without the maintenance operation.

An object of the present disclosure is to provide an image recording apparatus that is capable of providing a good image quality of an image to be recorded and making a time after a recording instruction is input until image recording is completed as short as possible.

According to an aspect of the present disclosure, there is provided an image recording apparatus, including: a conveyer configured to convey a medium in a conveyance direction; a recording head including a plurality of nozzles arranged in the conveyance direction; a carriage configured to move the recording head in a scanning direction intersecting with the conveyance direction; a signal output circuit configured to output a signal that varies depending on whether at least part of the nozzles is a discharge-defective nozzle of which discharge performance is lower than a predefined discharge performance; and a controller. The controller is configured to: set at least one nozzle included in the nozzles as a target nozzle, and determine whether the discharge-defective nozzle is included in the at least one target nozzle based on the signal from the signal output circuit; control the image recording apparatus to perform image recording on the medium by causing the image recording apparatus to perform a plurality of recording passes in each of which a liquid is discharged from the nozzles to the medium during movement in the scanning direction of the carriage and a conveyance operation in which the medium is conveyed in the conveyance direction by the conveyer; and control the image recording apparatus to perform image recording by a multi-pass recording mode in which a thinned-out image is recorded by conveying the medium in the conveyance operation such that a plurality of recording areas on the medium for which an image is to be recorded by the recording passes performed continuously partially overlap with each other, and by recording a line image corresponding to one line in the scanning direction in an overlapping area, where the recording areas overlap with each other, in the recording passes performed continuously by use of the nozzles different from each other so that different parts of the line image are thinned out based on mask data. In a case that the image recording is performed by the multi-pass recording mode, the controller is configured to: thin out part of the line image based on first mask data as the mask data in the recording passes performed continuously; in a case that the controller has determined that the discharge-defective nozzle is included in the nozzles, and in a case that a dot recording ratio that is a ratio of the number of dots of the thinned-out image to be recorded by the discharge-defective nozzle to the number of dots of an entirety of the line image is equal to or more than a threshold value by thinning out the part of the line image based on the first mask data, thin out the part of the line image based on second mask data as the mask data in the recording passes performed continuously, instead of thinning out the part of the line image based on the first mask data, the second mask data being data in which the dot recording ratio for the thinned-out image to be recorded by the discharge-defective nozzle is less than the threshold value.

When the dot recording ratio for the discharge-defective nozzle is large, and when image recording is performed without the discharge operation, the image quality of an image to be recorded deteriorates. On the other hand, when the dot recording ratio for the discharge-defective nozzle is small, and when image recording is performed without the discharge operation, the image quality of an image to be recorded does not deteriorate greatly.

In view of the above, in the present disclosure, when recording is performed using the multi-pass recording mode, part of the line image is thinned out based on the first mask data. On the other hand, when the discharge defective nozzle is included in the nozzles, and when the dot recording ratio for the discharge-defective nozzle is equal to or more than the threshold value by thinning out part of the line image based on the first mask data, the controller thins out part of the line image based on the second mask data, in which the dot recording ratio for the discharge-defective nozzle is less than the threshold value, instead of thinning out part of the line image based on the first mask data. Thus, performing image recording without the discharge operation for discharging ink in the recording head from the nozzles reduces a time after a recording instruction is input until image recording is completed, and reliably results in a good image quality of an image to be recorded.

BRIEF DESCRIPTION OF THE DRAWINGS

FIG. 15 illustrates a relationship between each ink color discharged from a discharge-defective nozzle and each threshold value compared to the dot recording ratio according to the third modified embodiment.

DESCRIPTION OF THE EMBODIMENTS

An embodiment of the present disclosure is explained below.

<Schematic Configuration of Printer>

Figure 1:
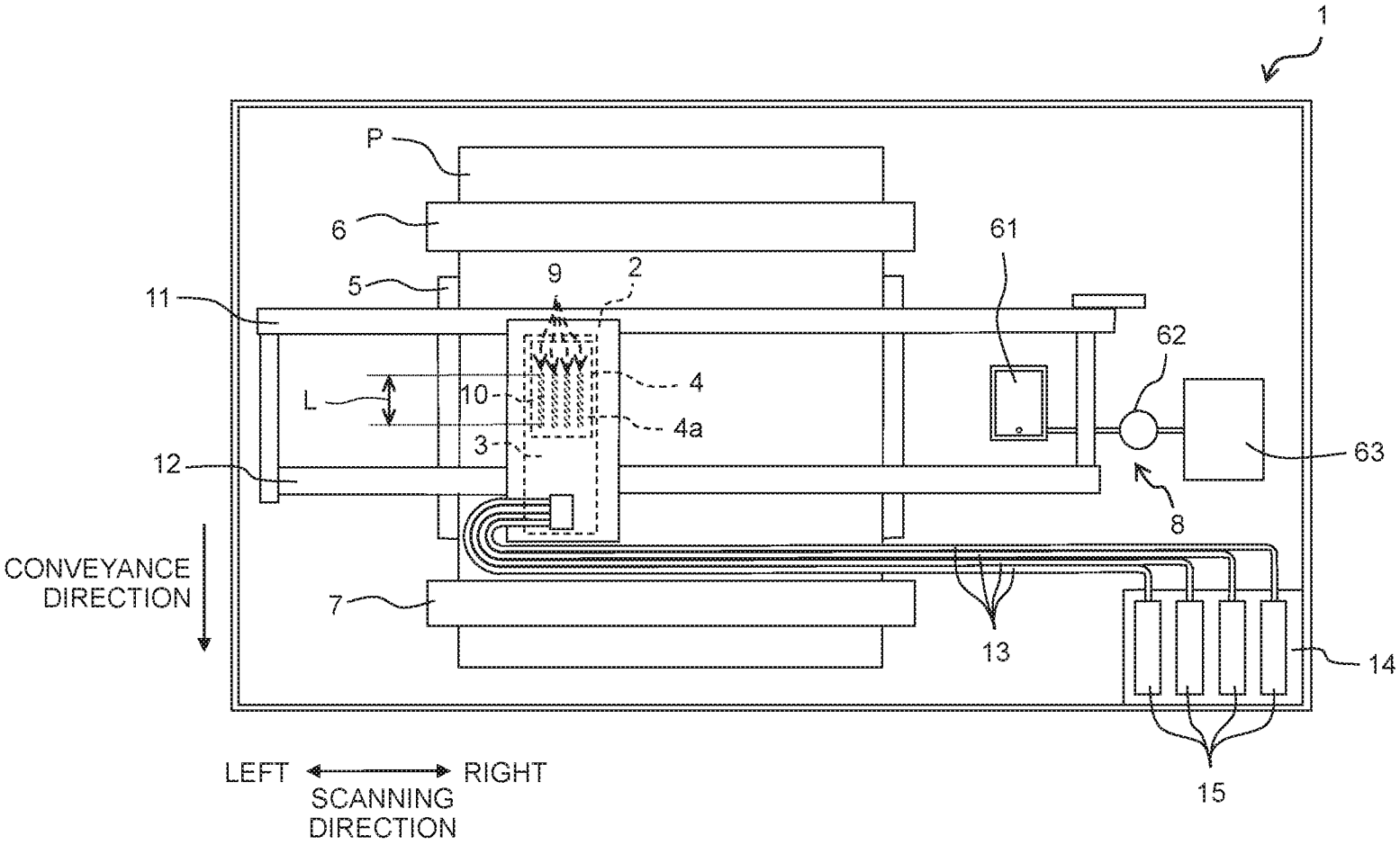
FIG. 1 schematically depicts a printer according to an embodiment of the present disclosure.

As depicted in FIG. 1, a printer 1 (an image recording apparatus of the present disclosure) according this embodiment includes a carriage 2, a subtank 3, an ink-jet head 4 (a recording head of the present disclosure), a platen 5, and conveyance rollers 6 and 7 (a conveyer of the present disclosure), a maintenance unit 8, and the like.

Figure 3:
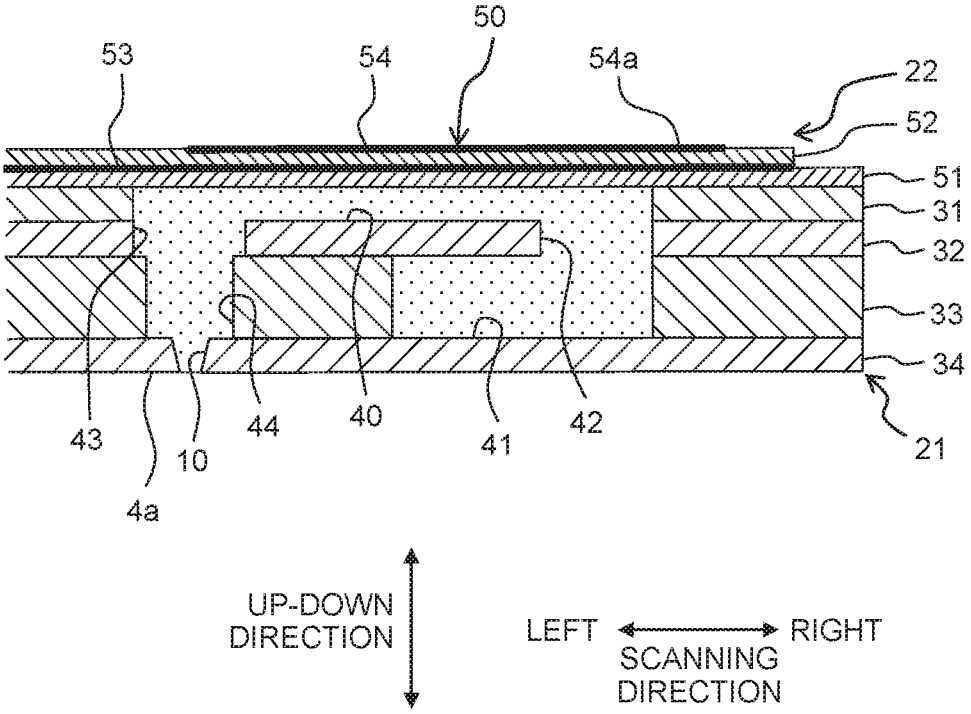
FIG. 3 is a cross-sectional view taken along a line in FIG. 2.

The carriage 2 is supported by two guide rails 11 and 12 extending in a scanning direction. The carriage 2 is connected to a carriage motor 86 (see FIG. 6) via a belt (not depicted). When the carriage motor 86 is driven, the carriage 2 moves along the guide rails 11 and 12 in the scanning direction. In the following description, the right and left sides in the scanning direction are defined as indicated in FIG. 1. An up-down direction of the printer 1 is defined as indicated in FIG. 3.

The carriage 2 carries the subtank 3. The printer 1 includes a cartridge holder 14. Four ink cartridges 15 are removably installed in the cartridge holder 14. The ink cartridge 15 disposed on the rightmost side in the scanning direction contains a black ink, the second rightmost ink cartridge 15 contains a yellow ink, the third rightmost ink cartridge 15 contains a cyan ink, and the leftmost ink cartridge 15 contains a magenta ink. The subtank 3 is connected to the four ink cartridges 15 installed in the cartridge holder 14 via four tubes 13. This allows the four color inks to be supplied from the four ink cartridges 15 to the subtank 3.

The ink-jet head 4 is mounted on the carriage 2 and connected to a lower end of the subtank 3. The inks of the four colors are supplied from the subtank 3 to the ink-jet head 4. Further, the ink-jet head 4 discharges the ink(s) from nozzles 10 formed in a nozzle surface 4*a* that is a lower surface thereof. More specifically, the ink-jet head 4 includes four nozzle rows 9 arranged in the scanning direction. In each nozzle row 9, the nozzles 10 are arranged in a conveyance direction to have a length L. The conveyance direction is orthogonal to the scanning direction. The black ink is discharged from the nozzles 10 belonging to the rightmost nozzle row 9 in the scanning direction, the yellow ink is discharged from the nozzles 10 belonging to the second rightmost nozzle row 9, the cyan ink is discharged from the nozzles 10 belonging to the third rightmost nozzle row 9, and the magenta ink is discharged from the nozzles 10 belonging to the leftmost nozzle row 9.

The platen 5 is disposed below the ink-jet head 4 and faces the nozzles 10. The platen 5 extends over an entire length of a recording sheet P (a recording medium of the present disclosure) in the scanning direction, and supports the recording sheet P from below. The conveyance roller 6 is disposed upstream of the ink-jet head 4 and the platen 5 in the conveyance direction. The conveyance roller 7 is disposed downstream of the ink-jet head 4 and the platen 5 in the conveyance direction. The conveyance rollers 6 and 7 are connected to a conveyance motor 87 (see FIG. 6) through gears (not depicted). Driving the conveyance motor 87 rotates the conveyance rollers 6 and 7, thus conveying the recording sheet P in the conveyance direction.

The maintenance unit 8 discharges the inks in the ink-jet head 4 from the nozzles 10 by performing a suction purge described below. The maintenance unit 8 is described below in detail.

<Ink-Jet Head>

Figure 2:
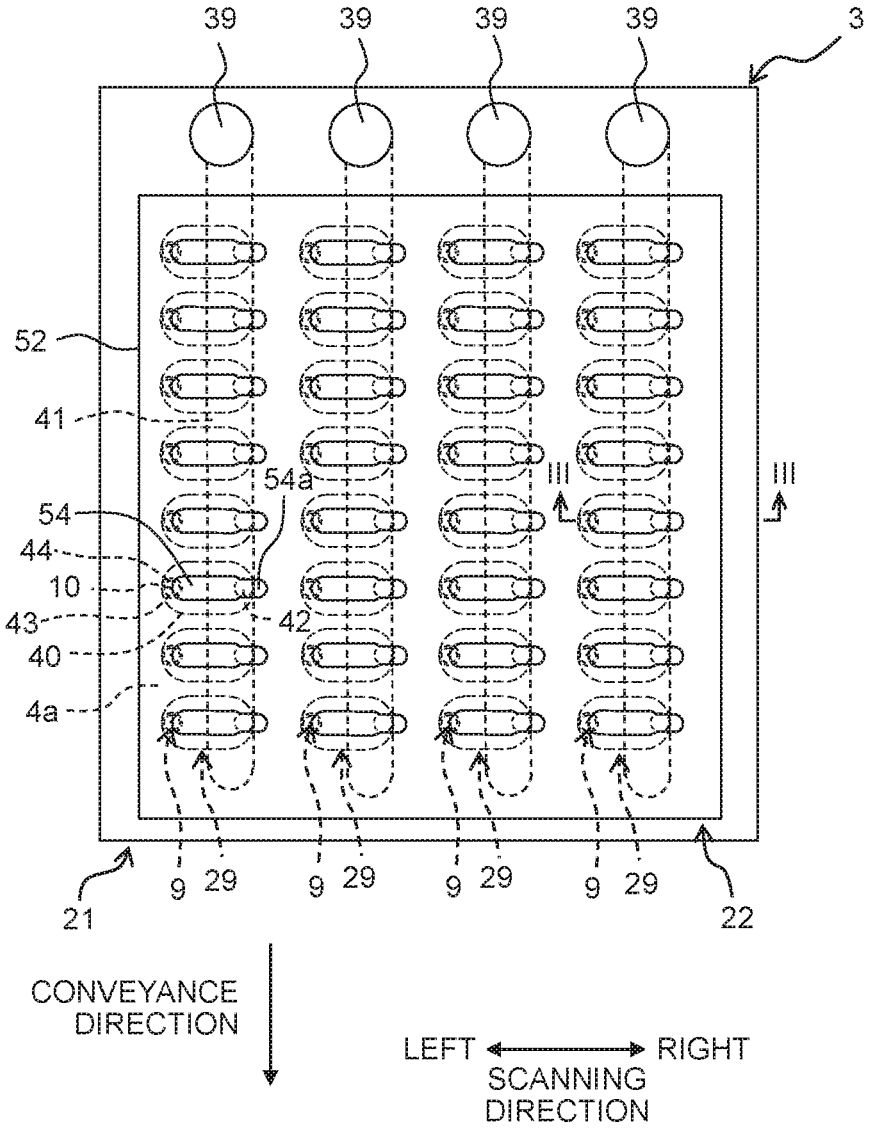
FIG. 2 is a plan view of an ink-jet head in FIG. 1.

Subsequently, the ink-jet head 4 is described below in detail. As depicted in FIGS. 2 and 3, the ink-jet head 4 includes a channel unit 21 and a piezoelectric actuator 22.

<Channel Unit>

The channel unit 21 includes four plates 31 to 34, which are stacked on top of each other in that order from the top. The plates 31 to 33 are made using a metal material, such as stainless steel. The plate 34 is made using a synthetic resin material, such as polyimide.

The nozzles 10 are formed in the plate 34. The nozzles 10 form the four nozzle rows 9 as described above. A lower surface of the plate 34 is the nozzle surface 4*a* of the ink-jet head 4. Pressure chambers 40 are formed in the plate 31. The pressure chamber 40 has an elliptical shape in plan view of which longitudinal direction is the scanning direction. The pressure chambers 40 communicate with the respective nozzles 10. A left end in the scanning direction of each of pressure chambers 40 overlaps in the up-down direction with the corresponding one of the nozzles 10. The plate 31 is formed having four pressure chamber rows 29 arranged in the scanning direction. The four pressure chamber rows 29 correspond to the four nozzle rows 9. Each pressure chamber row 29 includes the pressure chambers 40 arranged in the conveyance direction while corresponding to the nozzles 10.

The plate 32 has through holes 42 at portions overlapping in the up-down direction with right ends in the scanning direction of the respective pressure chambers 40. The through holes 42 have circular openings. The plate 32 has through holes 43 at portions overlapping in the up-down direction with the nozzles 10 and the left ends in the scanning direction of the respective pressure chambers 40. The through holes 43 have circular openings.

Four manifold channels 41 are formed in the plate 33. The four manifold channels 41 correspond to the four pressure chamber rows 29. Each of the manifold channels 41 extends in the conveyance direction and overlaps in the up-down direction with right portions in the scanning direction of the pressure chambers 40 forming the corresponding one of the pressure chamber rows 29. This allows the respective pressure chambers 40 to communicate with the manifold channel 41 via the through holes 42. A supply port 39 is provided at an upstream end in the conveyance direction of each manifold channel 41. The ink-jet head 4 is connected to a channel in the subtank 3 via the supply port 39. Each ink is thus supplied to the manifold channel 41 from the supply port 39. The plate 33 has through holes 44 at portions overlapping in the up-down direction with the through holes 43 and the nozzles 10. The through holes 44 have circular openings. The nozzles 10 thus communicate with the pressure chambers 40 via the through holes 43 and 44.

<Piezoelectric Actuator>

The piezoelectric actuator 22 includes a vibration plate 51, a piezoelectric layer 52, a common electrode 53, and individual electrodes 54. The vibration plate 51 is made using a piezoelectric material that includes lead zirconate titanate as a main component. The lead zirconate titanate is a mixed crystal of lead titanate and lead zirconate. The vibration plate 51 is disposed on an upper surface of the channel unit 21 to cover the pressure chambers 40. The vibration plate 51 may be made using any other insulating material than the piezoelectric material.

The piezoelectric layer 52 is made using the above-described piezoelectric material. The piezoelectric layer 52 is disposed on an upper surface of the vibration plate 51 and extends continuously over the pressure chambers 40. The common electrode 53 is disposed between the vibration plate 51 and the piezoelectric layer 52 and extends continuously over the pressure chambers 40. The common electrode 53 is connected to a power circuit (not depicted) via a trace member (not depicted). The common electrode 53 is kept at a ground potential.

The individual electrodes 54 correspond to the respective pressure chambers 40. Each individual electrode 54 has an elliptical shape in plan view that is smaller to some extent than the pressure chamber 40. The individual electrodes 54 are disposed on an upper surface of the piezoelectric layer 52 and overlap in the up-down direction with the center portions of the pressure chambers 40. The right end in the scanning direction of each individual electrode 54 extends rightward in the scanning direction to a position that does not overlap in the up-down direction with the pressure chamber 40, and the right end in the scanning direction of each individual electrode 54 functions as a connection terminal 54*a*. A trace member (not depicted) is connected to each connection terminal 54*a*. The individual electrodes 54 are connected to a driver IC 59 (see FIG. 6) via the trace members. The driver IC 59 selectively applies any of the ground potential and a predefined driving potential (e.g., about 20V) to the respective individual electrodes 54.

Corresponding to the arrangement of the common electrode 53 and the individual electrodes 54, portions of the piezoelectric layer 52 interposed between the common electrode 53 and the individual electrodes 54 are polarized in its thickness direction. In the piezoelectric actuator 22 having the above configuration, driving elements 50 are each formed by a portion of the vibration plate 51 overlapping in the up-down direction with the pressure chamber 40, a portion of piezoelectric layer 52 overlapping in the up-down direction with the pressure chamber 40, a portion of the common electrode 53 overlapping in the up-down direction with the pressure chamber 40, and the individual electrode 54. Each of the driving elements 50 applies pressure to the ink in the corresponding to one of the pressure chambers 40.

A method for discharging ink from the nozzles 10 by driving the piezoelectric actuator 22 is explained. In the piezoelectric actuator 22, all the individual electrodes 54 and the common electrode 53 are kept at the ground potential in advance. When ink is discharged from a certain nozzle 10, the electrical potential of the individual electrode 54 of the driving element 50 corresponding to the certain nozzle 10 is switched from the ground potential to the driving potential. The common electrode 53 is kept at the ground potential. Then, the potential difference between the individual electrode 54 and the common electrode 53 generates an electric field in the thickness direction parallel to a polarization direction in the portion (active portion) of the piezoelectric layer 52 interposed between the individual electrode 54 and the common electrode 53. This electric field contracts the active portion of the piezoelectric layer 52 in the horizontal direction, thus deforming the portion of the vibration plate 51 and the piezoelectric layer 52 overlapping in the up-down direction with the pressure chamber 40 so that the portion becomes convex toward the pressure chamber 40 as a whole. This reduces the volume of the pressure chamber 40 to increase the pressure of the ink in the pressure chamber 40, thereby discharging the ink from the nozzle 10 communicating with the pressure chamber 40.

<Maintenance Unit>

Next, the maintenance unit 8 is explained. As depicted in FIG. 1, the maintenance unit 8 includes a cap 61, a suction pump 62, and a waste liquid tank 63. The cap 61 is disposed on the right side in the scanning direction from the platen 5. When the carriage 2 is positioned at the maintenance position on the right side in the scanning direction from the platen 5, the nozzles 10 face the cap 61.

Figure 6:
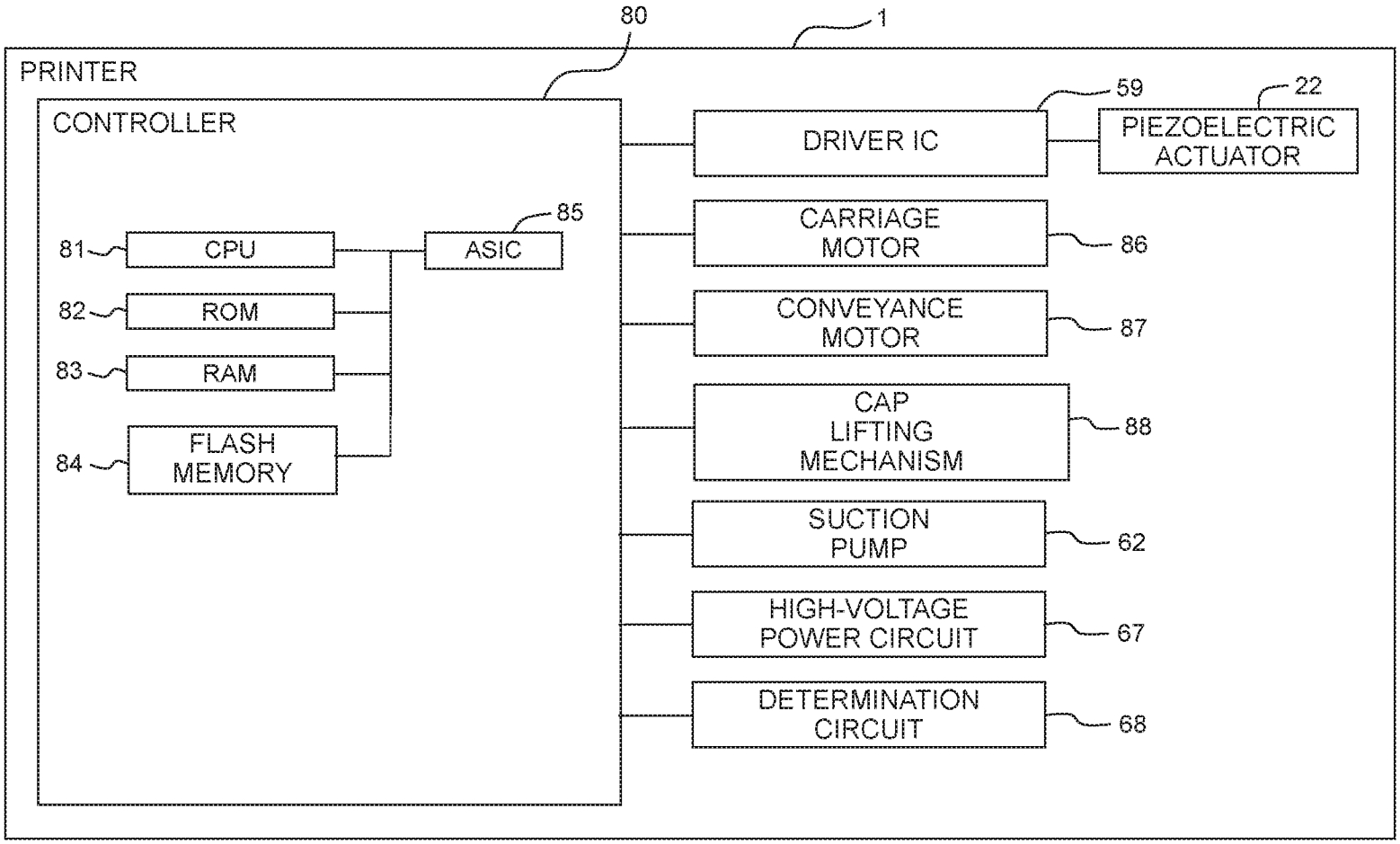
FIG. 6 is a block diagram depicting an electrical configuration of the printer.

The cap 61 can move up and down by a cap lifting mechanism 88 (see FIG. 6). The cap 61 can move upward by the cap lifting mechanism 88 in a state where the carriage 2 is positioned at the maintenance position such that nozzles 10 faces the cap 61. In this case, an upper end of the cap 61 is brought into close contact with the nozzle surface 4*a*, and the nozzles 10 are covered with the cap 61. The cap 61 is not limited to covering the nozzles 10 by being brought in close contact with the nozzle surface 4*a*. For example, the cap 61 may cover the nozzles 10 by being brought in close contact with a frame (not depicted) or the like disposed around the nozzle surface 4*a* of the ink-jet head 4.

The suction pump 62 is a tube pump or the like. The suction pump 62 is connected to the cap 61 and the waste liquid tank 63. In the maintenance unit 8, the suction pump 62 can be driven in a state where the nozzles 10 are covered with the cap 61 as described above. This makes it possible to perform the suction purge (a discharge operation of the present disclosure) in which the inks in the ink-jet head 4 are discharged from the nozzles 10. The inks discharged from the ink-jet head 4 are held in the waste liquid tank 63. In this embodiment, the maintenance unit 8 including the cap 61 and the suction pump 62 corresponds to a discharge mechanism of the present disclosure.

The above explanation has been made on the assumption that the cap 61 covers all the nozzles 10 collectively and the inks in the ink-jet head 4 are discharged from all the nozzles 10 in the suction purge, for the sake of convenience. The present disclosure, however, is not limited to such an aspect. For example, a portion covering the nozzles 10 belonging to the rightmost nozzle 9 from which the black ink is discharged and a portion covering the nozzles 10 belonging to the remaining three nozzle rows 9 that are disposed on the left of the rightmost nozzle row and from which color inks (yellow, cyan, and magenta inks) are discharged may be separately provided in the cap 61. Any of the black ink and the color inks in the ink-jet head 4 may be selectively discharged in the suction purge.

Figure 4:
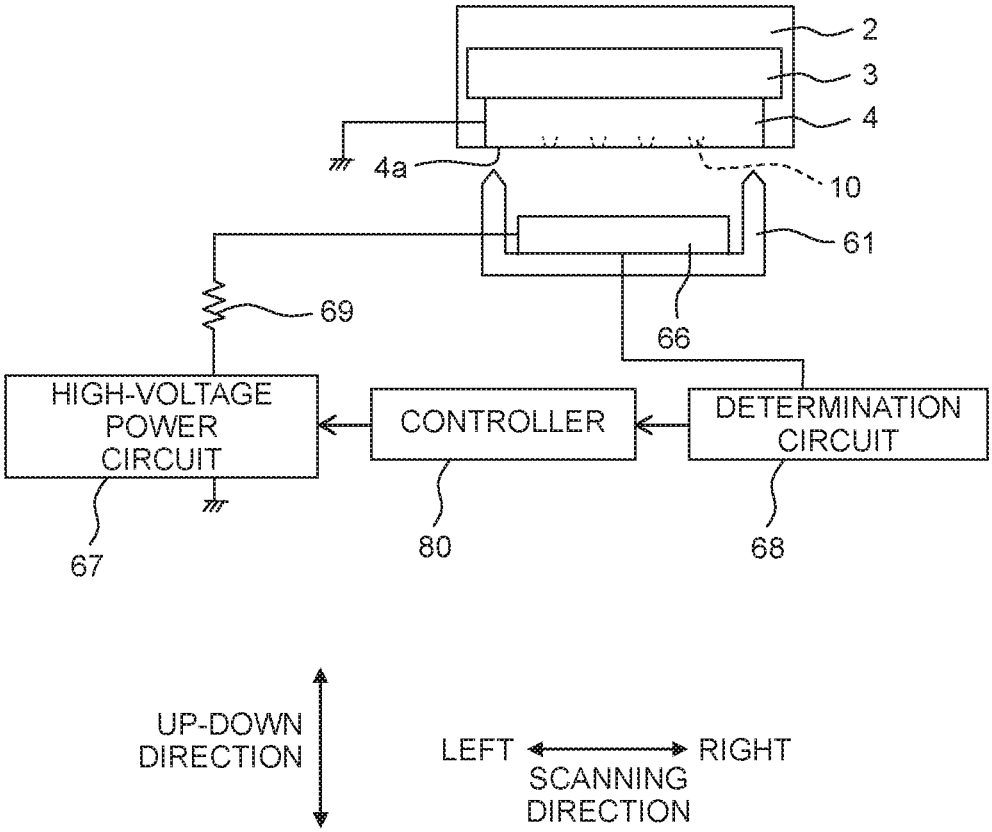
FIG. 4 illustrates a detection electrode disposed in a cap and illustrates a connection relationship between the detection electrode and a high-voltage power circuit and a connection relationship between the detection electrode and a determination circuit.

As depicted in FIG. 4, a detection electrode 66 having a rectangular shape in plan view is disposed in the cap 61. The detection electrode 66 is connected to a high-voltage power circuit 67 via a resistance 69. The high-voltage power circuit 67 applies a predefined positive potential (e.g., about 300 V) to the detection electrode 66. The channel unit 21 of the ink-jet head 4 is kept at the ground potential. This generates a predefined potential difference between the ink-jet head 4 and the detection electrode 66. A determination circuit 68 (a signal output circuit of the present disclosure) is connected to the detection electrode 66. The determination circuit 68 compares a voltage value of a voltage signal output from the detection electrode 66 with a threshold value Vt, and outputs a signal depending on the result.

Figure 5A:
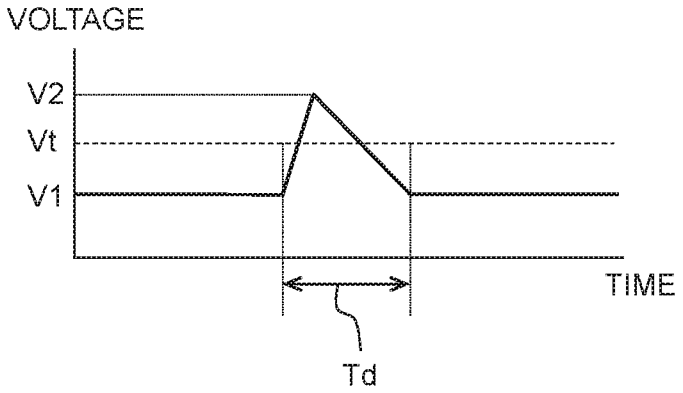
FIG. 5A depicts a change in voltage value of the detection electrode when ink is discharged from a nozzle.

More specifically, since the potential difference is generated between the ink-jet head 4 and the detection electrode 66, the ink discharged from the nozzle 10 is charged. Ink is discharged from the nozzle 10 toward the detection electrode 66 in a state where the carriage 2 is positioned at the maintenance position. As depicted in FIG. 5A, the voltage value of the detection electrode 66 increases until the charged ink approaches the detection electrode 66 and lands on the detection electrode 66. The voltage value of the detection electrode 66 reaches a voltage value V2 larger than a voltage value V1 obtained when the ink-jet head 4 is not driven. After the charged ink has landed on the detection electrode 66, the voltage value of the detection electrode 66 gradually decreases to the voltage value V1. That is, the voltage value of the detection electrode 66 changes during a driving period Td of the ink-jet head 4.

Figure 5B:
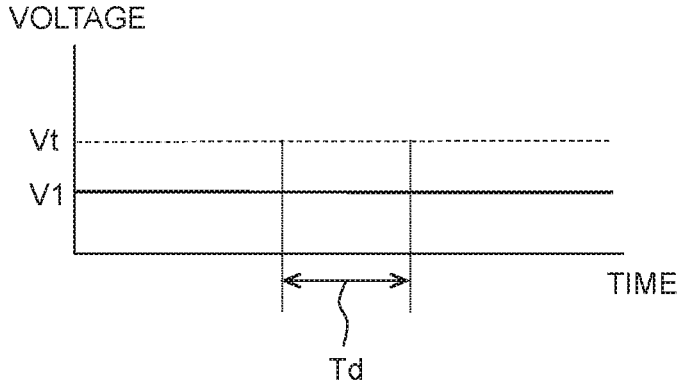
FIG. 5B depicts a change in voltage value of the detection electrode when no ink is discharged from the nozzle.

When ink is not discharged from the nozzle 10, as depicted in FIG. 5B, the voltage value of the voltage signal output from the detection electrode 66 during the driving period Td of the ink-jet head 4 hardly changes from the voltage value V1. Thus, the threshold value Vt ($V1<Vt<V2$) is set in the determination circuit 68 to distinguish these voltage values. The determination circuit 68 compares a maximum voltage value of the voltage signal output from the detection electrode 66 with the threshold value Vt during the driving period Td of the ink-jet head 4, and outputs a signal corresponding to the determination result.

In this embodiment, the high-voltage power circuit 67 applies the positive potential to the detection electrode 66. The high-voltage power circuit 67, however, may apply a negative potential (e.g., about −300V) to the detection electrode 66. In this case, when ink is discharged from the nozzle 10 to the detection electrode 66 in the state where the carriage 2 is positioned at the maintenance position, the voltage value of the detection electrode 66 decreases until the charged ink lands on the detection electrode 66.

<Electrical Configuration of Printer>

Next, an electrical configuration of the printer 1 is explained. The operation of the printer 1 is controlled by a controller 80. As depicted in FIG. 6, the controller 80 includes a Central Processing Unit (CPU) 81, a Read Only Memory (ROM) 82, a Random Access Memory (RAM) 83, a flash memory 84, an Application Specific Integrated Circuit (ASIC) 85, and the like. The controller 80 controls operations of the carriage motor 86, the conveyance motor 87, the driver IC 59, the cap lifting mechanism 88, the high-voltage power circuit 67, the suction pump 62, and the like. Further, the above-described signal is input from the determination circuit 68 to the controller 80.

In the controller 80, only the CPU 81 may perform a variety of processes, only the ASIC 85 may perform a variety of processes, or the CPU 81 may cooperate with the ASIC 85 to perform a variety of processes. In the controller 80, one CPU 81 may perform a process alone, or a plurality of CPU 81 may perform a process in a shared fashion. In the controller 80, one ASIC 85 may perform a process alone, or a plurality of ASIC 85 may perform a process in a shared fashion.

<Image Recording>

Subsequently, image recording on the recording sheet P by the printer 1 is explained. The printer 1 alternatingly performs a recording pass and a conveyance operation. In the recording pass, ink is discharged from the nozzles 10 of the ink-jet head 4 to the recording sheet P during the movement in the scanning direction of the carriage 2. In the conveyance operation, the recording sheet P is conveyed in the conveyance direction by use of the conveyance rollers 6 and 7. Accordingly, an image is recorded on the recording sheet P. The printer 1 can record the image on the recording sheet P by selectively using a single pass recording mode or a multi-pass recording mode.

Figure 7A:
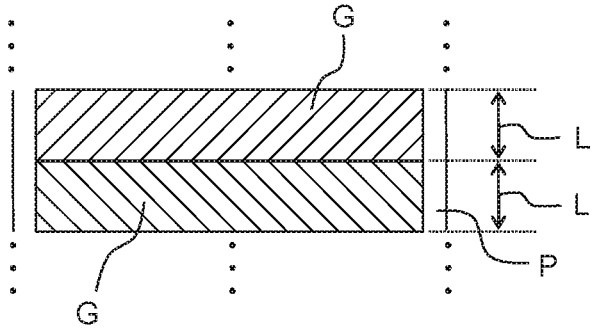
FIG. 7A depicts a positional relationship of two recording areas of a recording sheet when an image is recorded by two continuous recording passes by use of a single pass recording mode.

In the single pass recording mode, the recording paper P is conveyed in the conveyance operation by the length L of the nozzle row 9. Thus, when image recording is performed by using the single pass recording mode, as depicted in FIG. 7A, band-like recording areas G are formed adjacent to each other in the conveyance direction on the recording sheet P without overlapping with each other. The recording areas G are recorded by two continuous recording passes. The recording areas G extend in the scanning direction and the length in the conveyance direction is the length L.

Figure 7B:
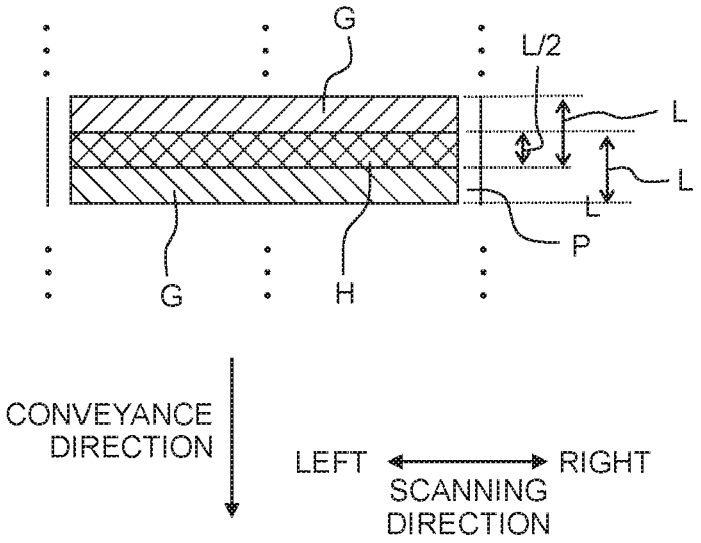
FIG. 7B depicts a positional relationship of two recording areas of the recording sheet when an image is recorded by two continuous recording passes by use of a multi-pass recording mode.

In the multi-pass recording mode, the recording paper P is conveyed in the conveyance operation by a length (L/2) that is half of the length L of the nozzle row 9. Thus, when image recording is performed using the multi-pass recording mode, as depicted in FIG. 7B, two recording areas G partially overlap with each other in an overlapping area H having the length (L/2) in the conveyance direction on the recording paper P. The recording areas G are recorded by two continuous recording passes. In the overlapping area H, a line image is formed by arranging dots in the scanning direction through the two recording passes. In the overlapping area H, a thinned-out image, which is obtained by thinning out part of the line image, is recorded through one recording pass.

Figure 8B:
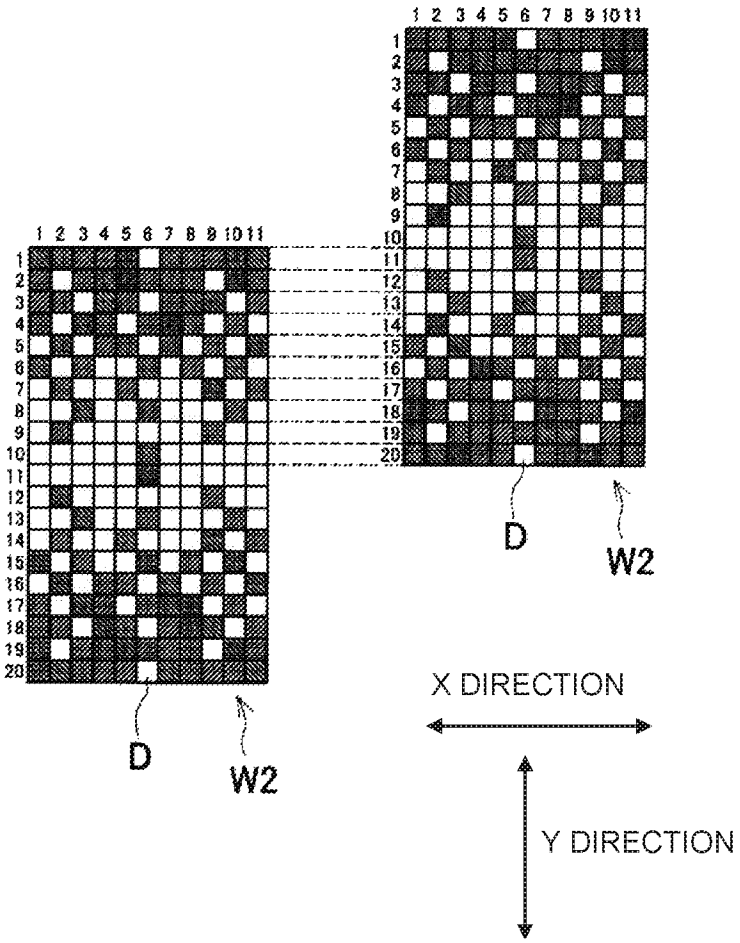
FIG. 8B illustrates second mask data.
Figure 8A:
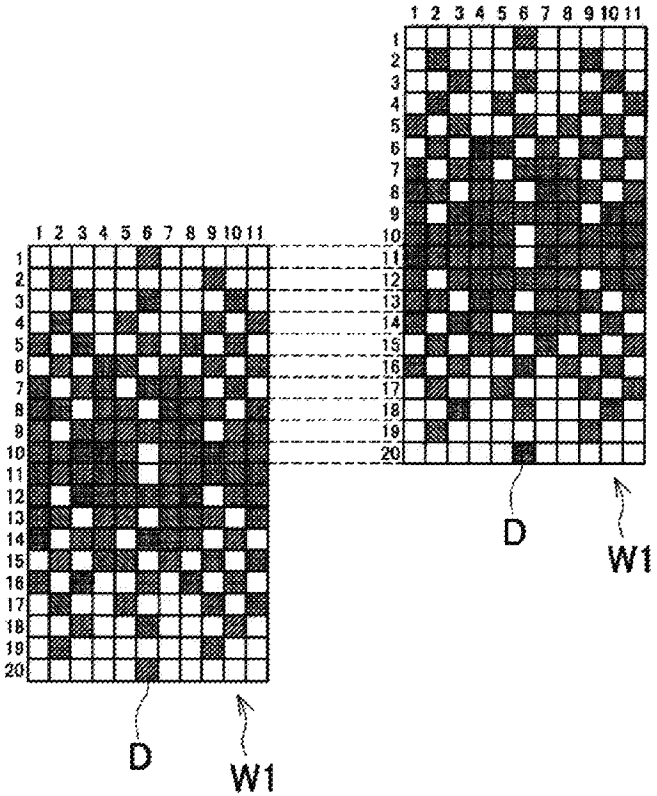
FIG. 8A illustrates first mask data.

The thinned-out image is obtained by selectively using any of a first mask data W1 depicted in FIG. 8A and a second mask data W2 depicted in FIG. 8B and thinning out part of the line image. The first mask data W1 and second mask data W2 are formed by a plurality of dot data D arranged lattice-likely in an X direction and a Y direction orthogonal to each other. The X direction corresponds to the scanning direction, and the Y direction corresponds to the conveyance direction. In FIGS. 8A and 8B, numbers 1, 2, 3, . . . , 10, and 11 arranged in the X direction each correspond to what-numbered dot from the left side in the scanning direction of the line image in an area for which recording is to be performed. Specifically, the M-th (M=1, 2, . . . , 11) dot data D from the left side in the X direction corresponds to [M+(11×1)]-th dot (I=0, 1, 2, . . . ) from the left side in the scanning direction of the line image in the area for which recording is to be performed. FIGS. 8A and 8B each depict that numbers 1, 2, 3, . . . , 19, and 20 arranged in the Y direction each correspond to what-numbered nozzle 10 from the upstream side in the conveyance direction. Although a number Nm of the nozzles 10 forming the nozzle row 9 is, for example, approximately 400, in order to simplify the drawing, the number Nm of the nozzles 10 forming the nozzle row 9 is 20 in FIGS. 8A and 8B. In FIGS. 8A and 8B, hatched dot data D indicates that ink discharge (dot formation) from the nozzle 10 is allowed, dot data D that is not hatched indicates that ink discharge from the nozzle 10 is prohibited (the dot is thinned out).

FIG. 8A indicates a relationship between the plurality of mask data W1 in two continuous recording passes when an image is recorded using the multi-pass recording mode. FIG. 8B indicates a relationship between the plurality of mask data W2 in two continuous recording passes when an image is recorded using the multi-pass recording mode. Specifically, the mask data W1 and the mask data W2 arranged at the left in FIGS. 8A and 8B correspond to an earlier recording pass of the two continuous recording passes, and the mask data W1 and the mask data W2 arranged at the right in FIGS. 8A and 8B correspond to a later recording pass included in the two continuous recording passes.

As indicated in FIGS. 8A and 8B, in the two continuous recording passes, the N-th row dot data D (N=1, 2, 3, . . . , (Nm/2)) and the (N+(Nm/2))-th row dot data D from the upstream side in the conveyance direction correspond to the same line image. As described above, FIGS. 8A and 8B satisfy Nm=20, and thus satisfy [Nm/2]=10. Further, in the plurality of mask data W1 and mask data W2, positions in the X direction of the dot data D allowing ink discharge and positions in the X direction of the dot data D prohibiting ink discharge are opposite to each other in the N-th row dot data D and the (N+(Nm/2))-th row dot data D from the upstream side in the conveyance direction. Thus, portions of the line image not overlapping with each other are recorded in the two respective continuous recording passes, and the line image is completed through the two continuous recording passes.

Figure 9B:
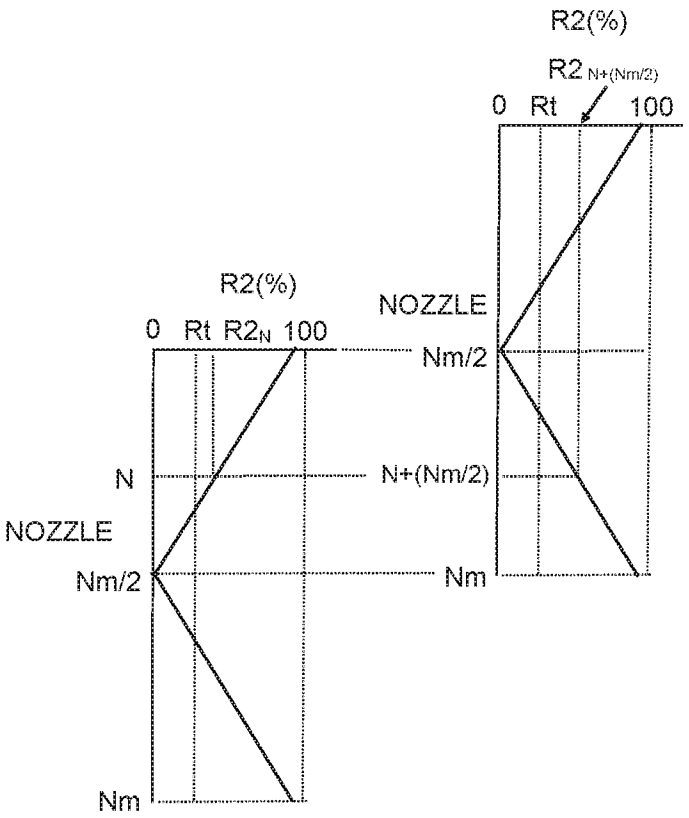
FIG. 9B illustrates a dot recording ratio for each nozzle in the second mask data.
Figure 9A:
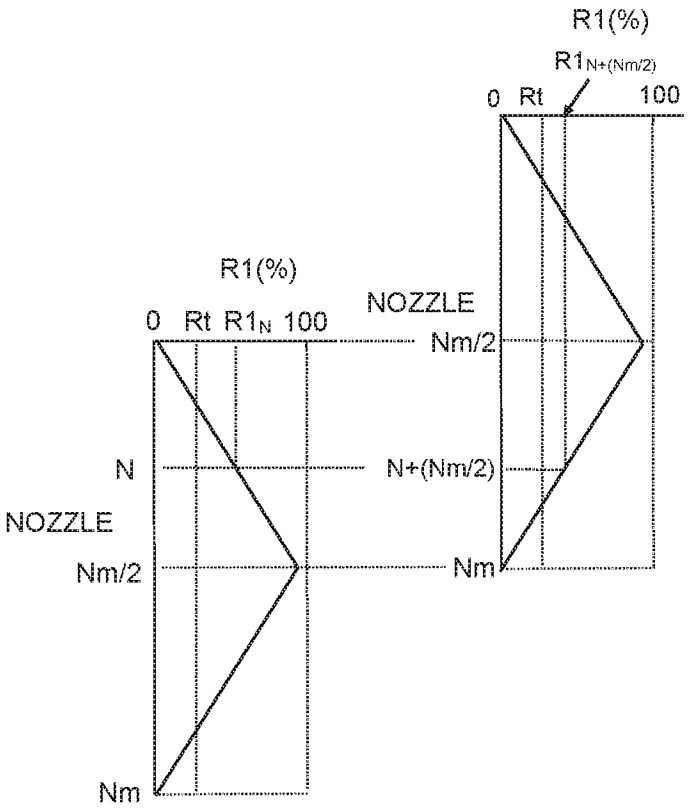
FIG. 9A illustrates a dot recording ratio for each nozzle in the first mask data.

FIG. 9A is an example indicating a dot recording ratio R1 for the thinned-out image recorded by each nozzle 10 in the first mask data W1. FIG. 9B is an example indicating a dot recording ratio R2 for the thinned-out image recorded by each nozzle 10 in the second mask data W2. The dot recording ratio is a ratio of the number of dots of the thinned-out image to the number of dots of the entire line image. In the following, "the dot recording ratio for the thinned-out image recorded by the ink discharged from the nozzle" may be simply referred to as "the dot recording ratio for the nozzle" or the like.

In FIGS. 9A and 9B, a vertical axis corresponds to what-numbered nozzle from the upstream side in the conveyance direction, and a horizontal axis indicates the dot recording ratio R1 [%] and the dot recording ratio R2 [%]. In the first mask data W1, a nozzle 10 included in the nozzles 10 of the ink-jet head 4 closer to a center portion in the conveyance direction has a larger dot recording ratio R1 [%]. In the second mask data W2, a nozzle 10 included in the nozzles 10 of the ink-jet head 4 closer to a center portion in the conveyance direction has a smaller dot recording ratio R2 [%]. In FIGS. 9A and 9B, "Rt" is a threshold value explained later. In this embodiment, Rt is about 33.3%.

The sum of the dot recording ratio R1 [%](hereinafter may be referred to as a dot recording ratio $R1_N$ [%]) and the dot recording ratio R2 [%](hereinafter may be referred to as a dot recording ratio $R2_N$ [%]) for the N-th nozzle 10 (N=1, 2, . . . Nm) from the upstream side in the conveyance direction is 100%. Namely, R2N [%]=(100−R1N) [%] is satisfied. In this embodiment, the first mask data W1 is saved in the flash memory 84. The controller 80 generates the second mask data W2 based on the relationship with the first mask data W1.

FIG. 9A depicts relationships between the dot recording ratios R1 and the nozzles 10 in the first mask data W1 in the two continuous recording passes when an image is recorded using the multi-pass recording mode. FIG. 9B depicts relationships between the dot recording ratios R2 and the nozzles 10 in the second mask data W2 in the two continuous recording passes when an image is recorded using the multi-pass recording mode. The relationships in FIGS. 9A and 9B correspond to positional relationships in the conveyance direction between the ink-jet head 4 and the recording sheet P in the two continuous recording passes. Specifically, the diagram disposed on the left in each of FIGS. 9A and 9B and indicating the dot recording ratio for each nozzle corresponds to the earlier recording pass of the two continuous recording passes, and the diagram disposed on the right in each of FIGS. 9A and 9B and indicating the dot recording ratio for each nozzle corresponds to the later recording pass of the two continuous recording passes.

As described above, in the two continuous recording passes, the N-th row dot data D (N=1, 2, 3, . . . , (Nm/2)) and the (N+(Nm/2))-th row dot data D from the upstream side in the conveyance direction correspond to the same line image. In the first mask data W1, the sum of a dot recording ratio $R1_N$ [%] for the N-th nozzle 10 and a dot recording ratio $R1N_{+(Nm/2)}$ [%] for the (N+(Nm/2))-th nozzle 10 from the upstream side in the conveyance direction is 100%. In the second mask data W2, the sum of a dot recording ratio $R2_N$ [%] for the N-th nozzle 10 and a dot recording ratio $R2N_{+(Nm/2)}$ [%] for the (N+(Nm/2))-th nozzle 10 from the upstream side in the conveyance direction is 100%.

The arrangements of the dot data D permitting ink discharge and the dot data D prohibiting ink discharge in the mask data W1 and the mask data W2 depicted in FIGS. 8A and 8B and the dot recording ratios R1 and R2 for the respective nozzles 10 depicted in FIGS. 9A and 9B are examples. The arrangements of the dot data D permitting ink discharge and the dot data D prohibiting ink discharge in the mask data W1 and the mask data W2 and the dot recording ratios R1 and R2 for the respective nozzles may be different from the examples in FIGS. 8A and 8B and FIGS. 9A and 9B.

<Control in Recording>

Next, control when the printer 1 records an image on the recording paper P is explained. When the printer 1 records an image on the recording paper P, the controller 80 performs processes in accordance with a flowchart in FIGS. 10A and 10B. The flowchart in FIGS. 10A and 10BA starts when a recording instruction for instructing the printer 1 to record an image on the recording paper P is input to the printer 1.

Figure 10A:
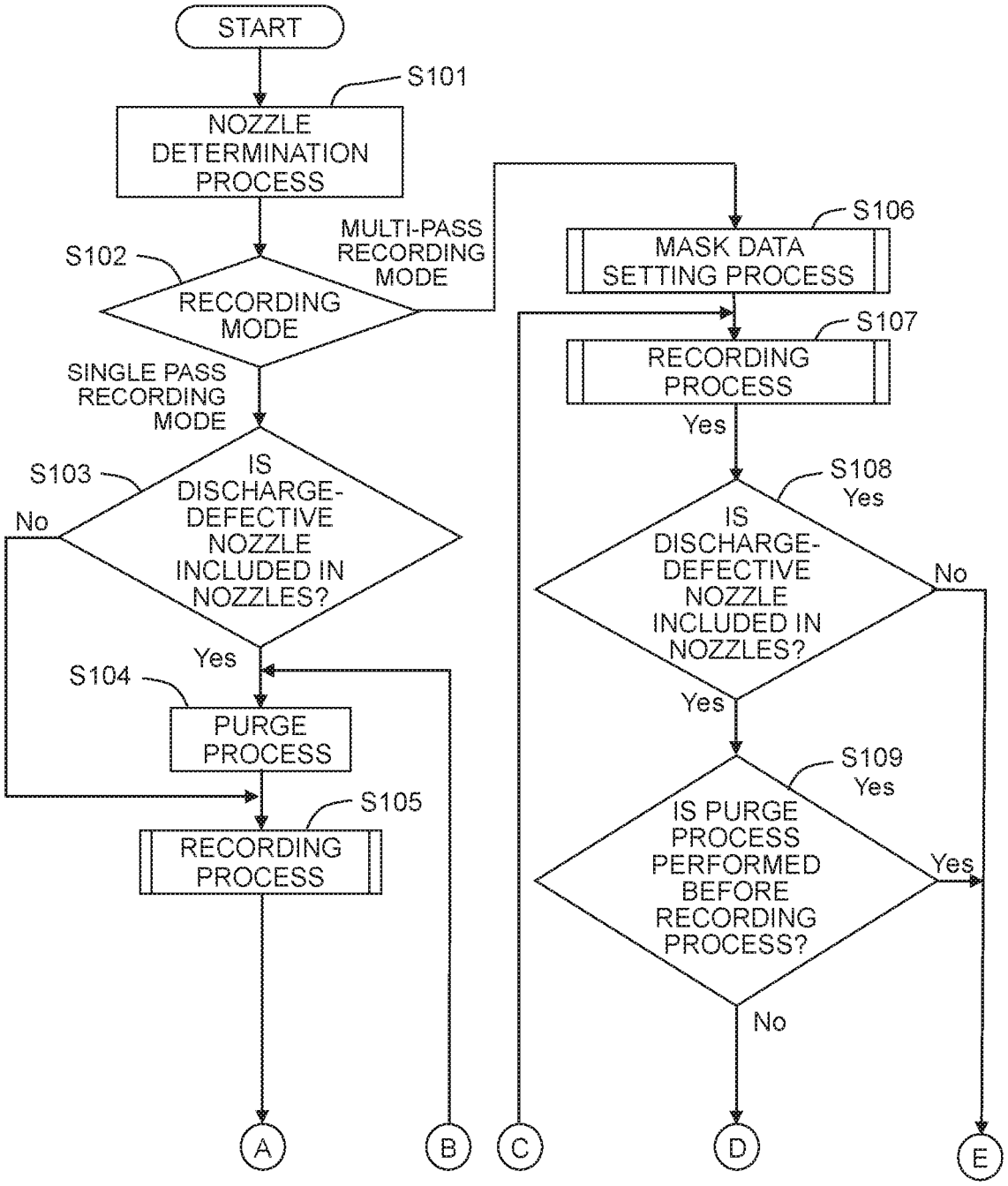
FIGS. 10A and 10B depict a flowchart indicating processes in recording.
Figure 10B:
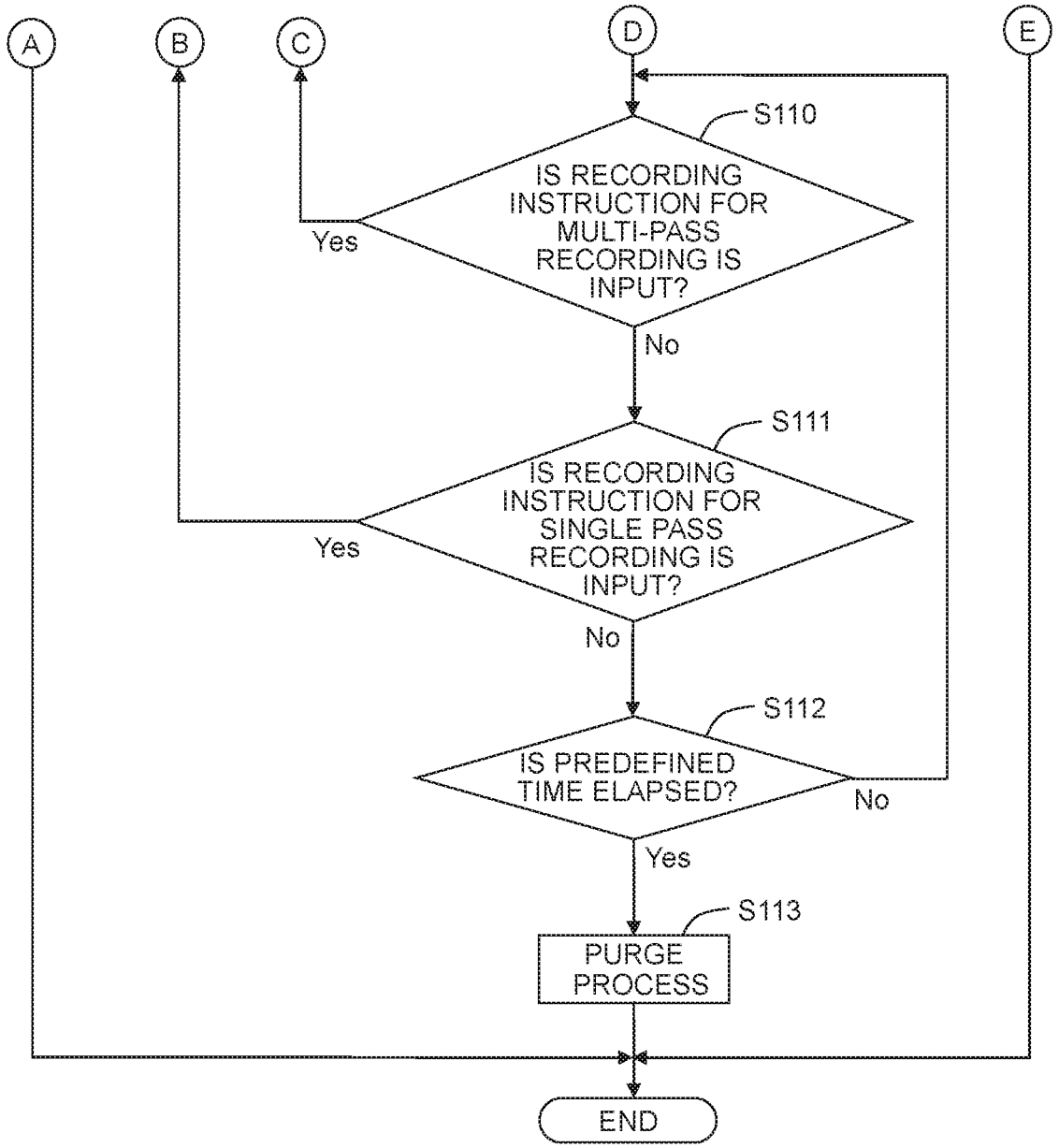

When the recording instruction is input to the printer 1, as indicated in FIGS. 10A and 10BA, the controller 80 first performs a nozzle determination process (S101). In the nozzle determination process, the controller 80 controls the carriage motor 86 to move the carriage 2 to the maintenance position. Then, the controller 80 controls the ink-jet head 4 to discharge ink from one of the nozzles 10 toward the detection electrode 66. This causes the determination circuit 68 to output a signal, which varies depending on whether or not ink is discharged from the one nozzle 10. The controller 80 thus determines whether the nozzle 10 is a discharge-defective nozzle based on the signal from the determination circuit 68. Ink may not be discharged properly from the nozzle 10 due to, for example, the increase in viscosity caused by the drying of ink in the nozzle 10. In other words, the discharge performance of the nozzle 10 may be lower than the predetermined discharge performance. The nozzle 10 from which ink can not be discharged properly is referred to as "the discharge-defective nozzle". Examples of the predetermined discharge performance include whether or not an ink droplet of a predetermined size can be jetted, whether or not the ink droplet can be jetted at a predetermined speed, and whether or not the ink droplet can be jetted in a predetermined direction. In this embodiment, when the signal from the determination circuit 68 indicates no ink is discharged from the nozzle 10, the controller 80 determines that the nozzle 10 is the discharge-defective nozzle. In S101, the controller 80 determines whether each of the nozzles 10 of the ink-jet head 4 is the discharge-defective nozzle as described above. Although the determination can be performed for all the nozzles 10, the determination can be performed for part of the nozzles 10 as needed. Namely, the controller can perform the determination for at least one nozzle 10.

Subsequently, the controller 80 determines the recording mode based on the recording instruction input (S102). Specifically, the controller 80 determines whether an image is recorded using the single pass recording mode or the multi-pass recording mode. For example, any of the recording modes may be set in the printer 1 in advance. When the printer 1 is set in advance to use the single pass recording mode, the controller 80 may directly proceed to a process in S103 described below after the process in S101. When the printer 1 is set in advance to use the multi-pass recording mode, the controller 80 may directly proceed to a process in S106 described below after the process in S101.

When image recording is performed using the single pass recording mode (S102: single pass recording mode), the controller 80 determines based on the determination result in S101 whether the nozzles 10 of the ink-jet head 4 include the discharge-defective nozzle (S103). When the nozzles 10 include the discharge-defective nozzle (S103: YES), the controller 80 performs a purge process for performing the above suction purge (S104), and then proceeds to a recording process in S105. When the nozzles 10 do not include the discharge-defective nozzle (S103: NO), the controller 80 directly proceeds to the recording process in S105 without performing the purge process in S104. After completing the recording process in S105, the controller 80 ends the series of processes in FIGS. 10A and 10B. The recording process in S105 is explained below.

When recording is performed using the multi-pass recording mode (S102: multi-pass recording mode), the controller 80 performs a mask data setting process for setting mask data used in recording (hereinafter may be referred to as used mask data) (S106).

Figure 11A:
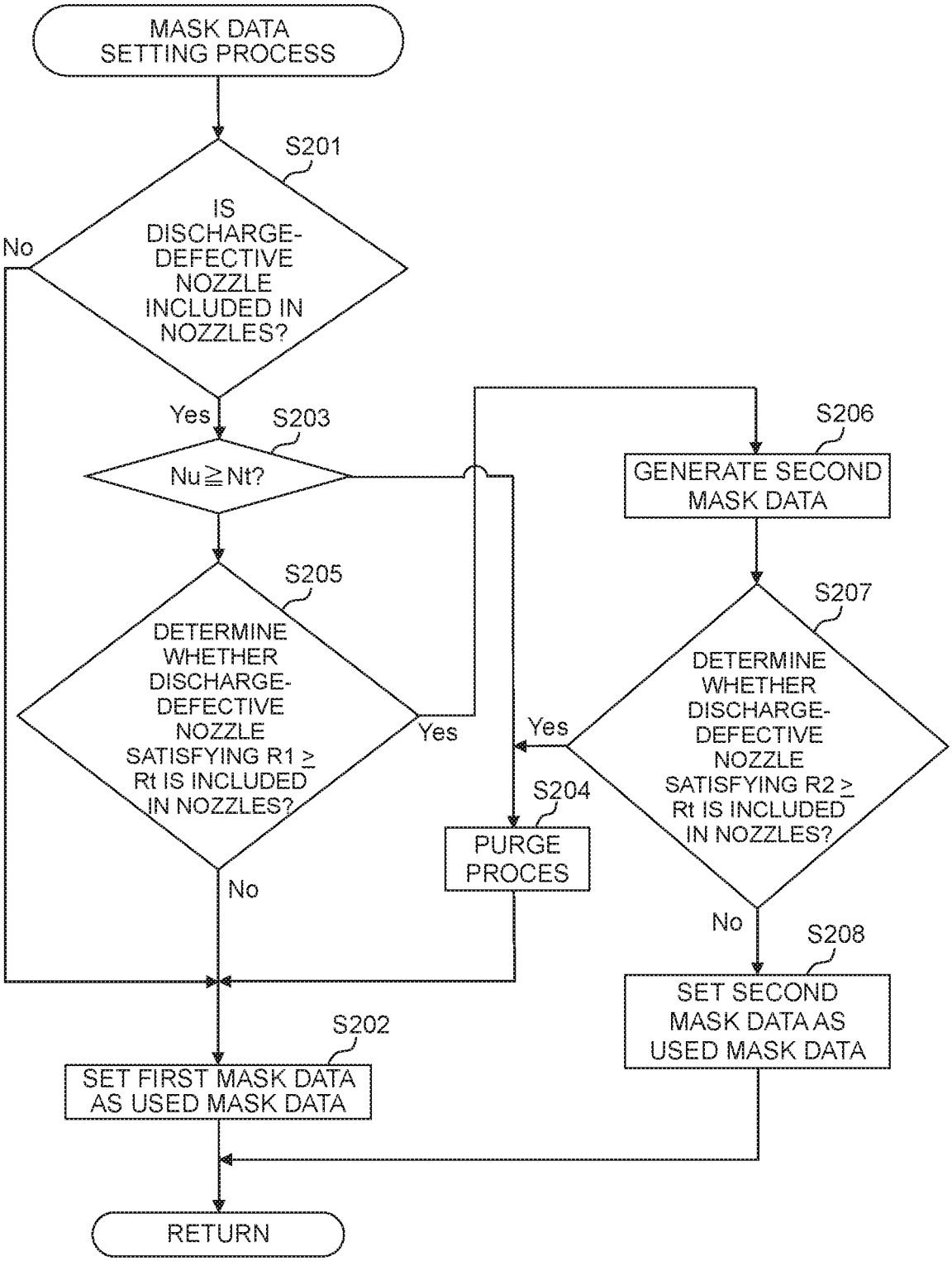
FIG. 11A is a flowchart indicating a mask data setting process in FIGS. 10A and 10B.

In the mask data setting process, as depicted in FIG. 11A, the controller 80 first determines whether the nozzles 10 of the ink-jet head 4 include the discharge-defective nozzle, similar to S103 (S201). When the nozzles 10 include no discharge-defective nozzle (S201: NO), the controller 80 sets the first mask data W1 as the used mask data (S202) and returns to the flowchart of FIGS. 10A and 10B.

When the nozzles 10 include the discharge-defective nozzle (S201: YES), the controller 80 determines whether the number of discharge-defective nozzles Nu is equal to or more than a predefined value Nt, based on the determination result in S101 (S203). When the number of discharge-defective nozzles Nu is equal to or more than the predefined value Nt (S203: YES), the controller 80 performs the purge process similar to S104 (S204), and sets the first mask data W1 as the used mask data (S202). Then, the controller 80 returns to the flowchart of FIGS. 10A and 10B.

When the number of discharge-defective nozzles Nu is less than the predefined value Nt (S203: NO), the controller 80 determines whether the discharge-defective nozzle, in which the dot recording ratio R1 is equal to or more than a threshold value Rt when part of the line image is thinned out based on the first mask data W1, is included in the nozzles 10 (S205). When the dot recording ratios R1 for all the discharge-defective nozzles are less than the threshold value Rt (S205: NO), the controller 80 sets the first mask data W1 as the used mask data (S202), and then returns to the flowchart of FIGS. 10A and 10B.

When the dot recording ratio R1 for at least one discharge-defective nozzle is equal to or more than the threshold value Rt (S205: YES), the controller 80 generates the second mask data W2 (S206) and determines whether the discharge-defective nozzle, in which the dot recording ratio R2 is equal to or more than the threshold value Rt when part of the line image is thinned out based on the second mask data W2, is included in the nozzles 10 (S207).

When the dot recording ratios R2 for all the discharge-defective nozzles are less than the threshold value Rt (S207: NO), the controller 80 sets the second mask data W2 as the used mask data (S208) and returns to the flowchart of FIGS. 10A and 10B. When the dot recording ratio R2 for at least one discharge-defective nozzle is equal to or more than the threshold value Rt (S207: YES), the controller 80 performs the purge process (S204), sets the first mask data W1 as the used mask data (S202), and returns to the flowchart of FIGS. 10A and 10B.

Returning to FIGS. 10A and 10B, after the mask data setting process in S106, the controller 80 performs the recording process (S107). The recording processes in S105 and S107 are explained. The recording process in S105 is substantially the same as the recording process in S107, except that they have different conveyance amounts of the recording sheet P in the conveyance operation. The recording processes in S105 and S107 are thus explained collectively.

Figure 11B:
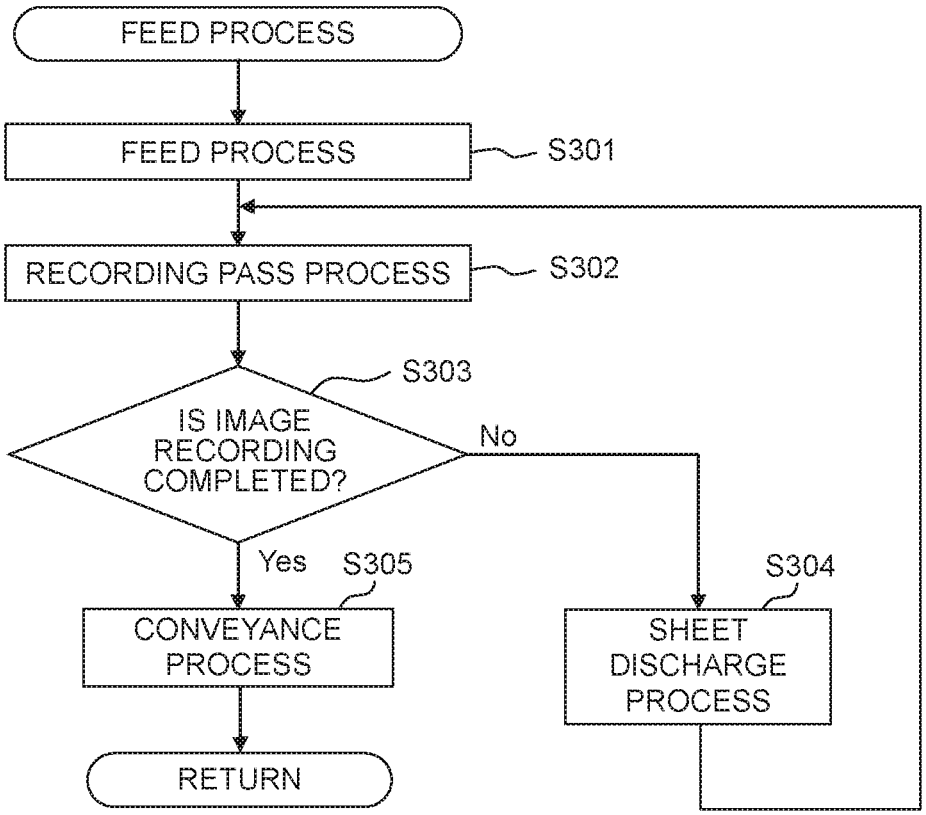
FIG. 11B is a flowchart indicating the recording process in FIGS. 10A and 10B.

In the recording processes of S105 and S107, as indicated in FIG. 11B, the controller 80 performs the feeding process (S301). In the feeding process, the controller 80 controls a feed mechanism (not depicted) and the conveyance motor 87 to feed the recording sheet P to a position where an area for which an image is recorded by the first recording pass faces the nozzles 10 of the ink-jet head 4.

Subsequently, the controller 80 performs a recording pass process (S302). In the recording pass process, the controller 80 controls the carriage motor 86 to move the carriage 2 in the scanning direction and controls the ink-jet head 4 via the driver IC 59 to discharge ink from the nozzles 10 to the recording sheet P. In the recording process of S107 (in a case of the multi-pass recording mode), recording of the line image is performed in S302 by thinning out part of the line image based on the mask data set in S106.

Subsequently, when image recording on the recording sheet P is not yet completed (S303: NO), the controller 80 returns to S302 after performing the conveyance operation (S304). In the conveyance operation of S304, the controller 80 controls the conveyance motor 87 to convey the recording sheet P in the conveyance direction by use of the conveyance rollers 6 and 7. In the recording process of S105 (in a case of the single pass recording mode), the recording paper P is conveyed by the length L of the nozzle row 9 in the conveyance operation of S304. In the recording process of S107 (in a case of the multi-pass recording mode), the recording paper P is conveyed by the length (L/2) that is half the length L of the nozzle row 9 in the conveyance operation of S304. Accordingly, the recording pass and the conveyance operation are performed alternatingly until the image recording on the recording sheet P is completed. In the recording process of S107 (in the case of the multi-pass recording mode), the line image is recorded by thinning out part of the line image based on the same mask data set in S106.

When the image recording on the recording sheet P is completed (S303: YES), the controller 80 performs a sheet discharge process (S305), and then returns to the flowchart of FIGS. 10A and 10B. In the sheet discharge process of S305, the controller 80 controls the conveyance motor 87 to convey the recording sheet P in the conveyance direction by use of the conveyance rollers 6 and 7, thereby discharging the recording sheet P from the printer 1.

Referring to FIGS. 10A and 10B, after the recording process of S107, the controller 80 ends the series of processes when the controller 80 has determined in S201 that the nozzles 10 include no discharge-defective nozzle (S108: NO). Or, the controller 80 ends the series of processes when the controller 80 has determined in S201 that the nozzles 10 include the discharge-defective nozzle (S108: YES) and when the purge process of S204 is performed (S109: YES) before the recording process of S107.

When the controller 80 has determined that the nozzles 10 include the discharge-defective nozzle (S108: YES) and when the purge process of S204 is not performed before the recording process of S107 (S109: NO), the controller 80 performs the following process. When a recording instruction for instructing the printer 1 to record an image by the next multi-pass recording mode is input to the printer 1 (S110: YES) until a predefined time elapses (S112: NO), the controller 80 returns to S107. When a recording instruction for instructing the printer 1 to record an image by the next single pass recording mode is input to the printer 1 (S111: YES) until the predefined time elapses (S112: NO), the controller returns to S104. When the predefined time has elapsed without the next recording instruction being input (S110: NO, S111: NO, S112: YES), the controller 80 performs the same purge process (S113) as S104 and S204, and ends the series of processes in FIGS. 10A and 10B.

<Technical Effects>

When the dot recording ratio for the discharge-defective nozzle is large, and when image recording is performed without the suction purge, the image quality of the image to be recorded deteriorates. On the other hand, when the dot recording ratio for the discharge-defective nozzle is small, the image quality of the image to be recorded does not deteriorate greatly even when image recording is performed without the suction purge.

Thus, in this embodiment, when recording is performed using the multi-pass recording mode, part of the line image is thinned out based on the first mask data W1. However, when the discharge-defective nozzle is included in the nozzles 10 and when the dot recording ratio R1 for at least one discharge-defective nozzle is equal to or more than the threshold value Rt by thinning out part of the line image based on the first mask data W1, part of the line image is thinned out based on the second mask data W2 in which the dot recording ratios R2 for all the discharge-defective nozzles are less than the threshold value Rt. Then, image recording is performed without the suction purge. This reliably results in a good image quality of the image to be recorded while reducing a time after the recording instruction is input until the image recording is completed.

In this embodiment, the line image is recorded by two continuous recording passes. The first mask data W1 and the second mask data W2 are mask data satisfying the relation $R2_N[\%]=(100-R1_N)$ [%]. Thus, when the dot recording ratio R1 for the discharge-defective nozzle is equal to or more than the threshold value Rt, the dot recording ratio R2 for the discharge-defective nozzle is less than the threshold value Rt. Further, in that case, the dot recording ratio R2 is larger than the dot recording ratio R1 for the nozzles 10 that are used for recording the same line image as the discharge-defective nozzle and are not the discharge-defective nozzle. In that case, the line image can be recorded appropriately without changing the number of times of the recording passes for recording the line image.

Unlike this embodiment, for example, it is assumed that mask data, in which only the dot recording ratio for the discharge-defective nozzle is decreased with respect to the first mask data W1, is used as the mask data for the earlier recording pass of two continuous recording passes, and that mask data, in which only the dot recording ratio for the nozzle corresponding to the same line image as the discharge-defective nozzle is increased with respect to the first mask data W1, is used as the mask data for the later recording pass of the two continuous recording passes. However, in this case, the mask data used for the earlier recording pass of the two continuous recording passes needs to be different from the mask data used for the later recording pass of the two continuous recording passes. Further, when such mask data is used, the difference in dot recording ratios for the two recording passes is large between the line image corresponding to the discharge-defective nozzle and the line image adjacent in the conveyance direction to the line image corresponding to the discharge-defective nozzle. This makes image deterioration conspicuous.

In this embodiment, since part of the line image is thinned out based on the second mask data W2, the same mask data can be used for all the recording passes. Further, the difference in dot recording ratios for the two recording passes is not large between the line image corresponding to the discharge-defective nozzle and the line image adjacent in the conveyance direction to the line image corresponding to the discharge-defective nozzle.

When part of the line image is thinned out based on the first mask data W1, the dot recording ratio R1 for at least one discharge-defective nozzle may be equal to or more than the threshold value Rt. Further, even when part of the line image is thinned out based on the second mask data W2, the dot recording ratio R2 for at least one discharge-defective nozzle may be equal to or more than the threshold value Rt (i.e., the case in which the dot recording ratios R2 for all the discharge-defective nozzles are less than the threshold value Rt, and the case in which the second mask data can not be generated). In such cases, image recording is performed after the discharge-defective nozzle is recovered through the suction purge. This inhibits the image quality of the image to be recorded from deteriorating.

In this embodiment, when the controller 80 has determined that the discharge-defective nozzle is included in the nozzles 10, image recording using the multi-pass recording mode is performed on the recording sheet P without performing the suction purge. In this case, when no recording instruction is input until a predefined time elapses, the abnormality of the discharge-defective nozzle can be removed by performing the suction purge. On the other hand, when the controller 80 has determined that the discharge-defective nozzle is included in the nozzles 10, image recording using the multi-pass recording mode is performed on the recording sheet P without performing the suction purge. In this case, when a recording instruction for instructing the printer 1 to record an image by the multi-pass recording mode is input after the image recording is completed until the predefined time elapses, no suction purge is performed. Then, image recording is performed on the recording sheet P based on the recording instruction. This reduces the frequency of the suction purge, which inhibits useless ink consumption.

In this embodiment, when the number of discharge-defective nozzles is large, the image quality of the image to be recorded deteriorates even when the dot recording ratio for the thinned-out image to be recorded by the discharge-defective nozzle is small. In order to solve that problem, in this embodiment, when the number of discharge-defective nozzles Nu exceeds the predefined value Nt, image recording is performed after the suction purge even when any other conditions for image recording that does not need the suction purge are satisfied. This inhibits the image quality of the image to be recorded from deteriorating.

When image recording is performed by the single pass recording mode, and when the nozzles 10 include the discharge-defective nozzle, image recording can be performed on the recording sheet P without performing the suction purge. However, in this case, a line image corresponding to the discharge-defective nozzle is not recorded and a white streak is generated in an area of the recording sheet P where the line image corresponding to the discharge-defective nozzle should be recorded.

In order to solve that problem, in this embodiment, when an image is recorded by the single pass recording mode and when the nozzles 10 include the discharge-defective nozzle, image recording is performed on the recording sheet P after the suction purge. This inhibits the white streak that may otherwise be caused in the image to be recorded.

As described above, when the dot recording ratio for the discharge-defective nozzle is small, the image quality of the image to be recorded does not deteriorate greatly even when the image is recorded without performing the suction purge.

In view of the above, when recording is using the multi-pass recording mode, when the discharge-defective nozzle is included in the nozzles 10, and when the dot recording ratio R1 for the discharge-defective nozzle is equal to or more than the threshold value Rt by thinning out part of the line image based on the first mask data W1, image recording is performed without the suction purge by tinning out part of the line image based on the first mask data W1. This reliably results in a good image quality of the image to be recorded while reducing a time after the recording instruction is input until the image recording is completed.

Modified Embodiments

The embodiment of the present disclosure is explained above. The present disclosure, however, is not limited to the above embodiment. Various changes or modifications may be made without departing from the claims.

In the above embodiment, when image recording is performed using the multi-pass recording mode, and when the image recording is performed after the suction purge in S204, the first mask data W1 is set as the used mask data. The present disclosure, however, is not limited to such an aspect. When image recording is performed using the multi-pass recording mode, and when the image recording is performed after the suction purge in S204, the second mask data W2 may be used as the used mask data.

In the above embodiment, the controller 80 can generate the second mask data W2 based on the first mask data W1. The present disclosure, however, is not limited to such an aspect. The controller 80 can generate a second mask data different from the second mask data W2. Here, the controller 80 may generate a second mask data that makes the dot recording ratio R2 for the discharge-defective nozzle less than the threshold value when the dot recording ratio R1 for the discharge-defective nozzle is equal to or more than the threshold value, and that makes the dot recording ratio R2 for the nozzle 10, which is used to record the same line image as the discharge-defective nozzle and is not the discharge-defective nozzle, larger than the dot recording ratio R1.

Further, the controller 80 can generate only one kind of mask data (second mask data W2) based on the first mask data W1. The present disclosure, however, is not limited to such an aspect. For example, the controller 80 may be capable of generating a plurality of kinds of mask data different from the first mask data W1 based on the first mask data W1. In this case, the plurality of kinds of mask data that can be generated by the controller 80 may include mask data similar to the second mask data W2 and mask data different from the second mask data, or may include only mask data different from the second mask data W2.

In that case, when the line image is thinned out by using any of the plurality of kinds of mask data, and when the dot recording ratios for all the discharge-defective nozzles are less than the threshold value Rt, the mask data is set as the second mask data. When there are a plurality of such mask data, one of them is set as the second mask data. When the dot recording ratio for at least one discharge-defective nozzle is less than the threshold value Rt after the line image is thinned out by using any of the plurality of kinds of mask data, image recording is performed after the suction purge.

In the above embodiment, the controller 80 generates the second mask data W2 based on the first mask data W1. The present disclosure, however, is not limited to such an aspect.

Figure 12:
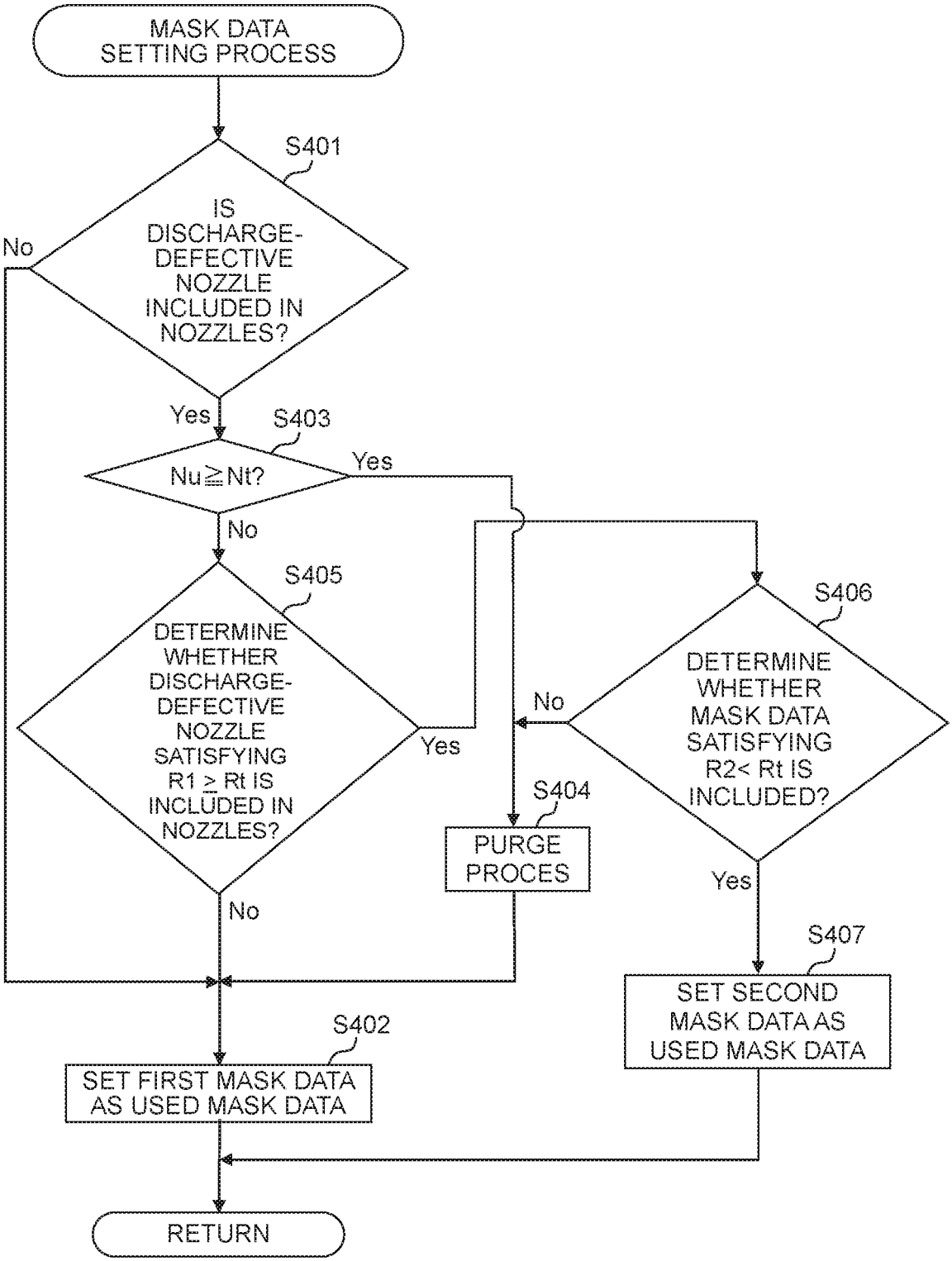
FIG. 12 is a flowchart indicating a mask data setting process according to the first modified embodiment.

In the first modified embodiment, a plurality kinds of mask data are saved in the flash memory 84 (a memory of the present disclosure). One of the plurality of kinds of mask data is the set as the first mask data. In the mask data setting process of the first modified embodiment, the controller 80 performs processes in accordance with a flowchart of FIG. 12 to set the mask data used to perform recording by the multi-pass recording mode.

More specifically, in the mask data setting process of the first modified embodiment, when no discharge-defective nozzle is included in the nozzles 10 (S401: NO), the controller 80 sets the first mask data as the used mask data (S402) similar to the above embodiment. When the discharge-defective nozzle is included in the nozzles 10 (S401: YES) and the number of discharge-defective nozzles Nu is equal to or more than the predefined value Nt (S403: YES), the controller 80 performs the purge process (S404), and sets the first mask data as the used mask data (S302). When the discharge-defective nozzle is included in the nozzles 10 (S401: YES), when the number of discharge-defective nozzles Nu is less than the predefined value Nt (S403: NO), and when the dot recording ratios R1 for all the discharge-defective nozzles are less than the threshold value R1 (S405: NO), the controller 80 sets the first mask data as the used mask data (S402).

When the discharge-defective nozzle is included in the nozzles 10 (S401: YES), when the number of discharge-defective nozzles Nu is less than the predefined value Nt (S403: NO), and when the discharge-defective nozzle of which dot recording ratio R1 is equal to or more than the threshold value Rt is included in the nozzles 10 (S405: YES), the controller 80 determines whether mask data, in which the dot recording ratios R2 for all the discharge-defective nozzles are less than the threshold value Rt, is included in mask data included in the plurality of kinds of mask data and from which the first mask data is removed (S406).

When such mask data is included therein (S406: YES), the controller 80 sets such mask data as the second mask data, and sets the second mask data as the used mask data (S407). Here, when a plurality of such mask data are included therein, one of them is set as the second mask data. When no such mask data is included therein (S406: NO), the controller 80 performs the purge process (S404) and the first mask data is set as the used mask data (S402).

In the first modified embodiment, the plurality of kinds of mask data are saved in the flash memory 84 in advance. One of the plurality of kinds of mask data is set as the first mask data, and any of the plurality of kinds of mask data from which the first mask data is removed is set as the second mask data. This eliminates a process for generating the second mask data.

When the mask data in which the dot recording ratios R2 for all the discharge-defective nozzles are less than the threshold value Rt, is not included in the mask data included in the plurality kinds of of mask data from which the first mask data is removed, image recording is performed after the suction purge. This inhibits the decrease in image quality of the image to be recorded.

In the above embodiment, image recording is performed after the suction purge, when the dot recording ratio R1 for at least one discharge-defective nozzle is equal to or more than the threshold value Rt by thinning out the line image based on the first mask data W1, and when the dot recording ratio R2 for at least one discharge-defective nozzle is equal to or more than the threshold value Rt by thinning out the line image based on the second mask data W2. The present disclosure, however, is not limited to such an aspect. For example, in such a case, image recording may be performed without the suction purge by thinning out the line image by use of mask data included in the mask data W1 and W2 and having a smaller average value of the dot recording ratios for the discharge-defective nozzles.

In the first modified embodiment, image recording is performed after the suction purge when the dot recording ratio R1 for at least one discharge-defective nozzle is equal to or more than the threshold value Rt by thinning out the line image based on the first mask data, and when the mask data, in which the dot recording ratios R2 for all the discharge-defective nozzles are equal to or more than the threshold value Rt, is not included in the mask data included in the plurality of kinds of mask data saved in the flash memory 84 from which the first mask data is removed. The present disclosure, however, is not limited to such an aspect. For example, in such a case, image recording may be performed without the suction purge by thinning out the line image by use of mask data included in the plurality of kinds of mask data saved in the flash memory 84 and having the smallest average value of the dot recording ratios for the discharge-defective nozzles obtained when the line image is thinned out.

In the above embodiment, when image recording is performed on the recording sheet P by the multi-pass recording mode, two recording areas G of the recording sheet P to be recorded by two continuous recording passes partially overlap with each other. Then, a thinned-out image obtained by thinning out different portions of the line image is recorded through the two recording passes in the overlapping area H where the two recording areas G overlap with each other. The present disclosure, however, is not limited to such an aspect. When image recording is performed on the recording sheet P by the multi-pass recording mode, three or more recording areas of the recording sheet P to be recorded by three or more recording passes may partially overlap with each other. Then, a thinned-out image obtained by thinning out different portions of the line image may be recorded through the three or more recording passes in the overlapping area where the three or more recording areas overlap with each other.

In the above embodiment, one line image is recorded by the same number of times of continuous recording passes, when part of the line image is thinned out based on the first mask data W1 and when part of the line image is thinned out based on the second mask data W2. The present disclosure, however, is not limited to such an aspect.

Figure 13:
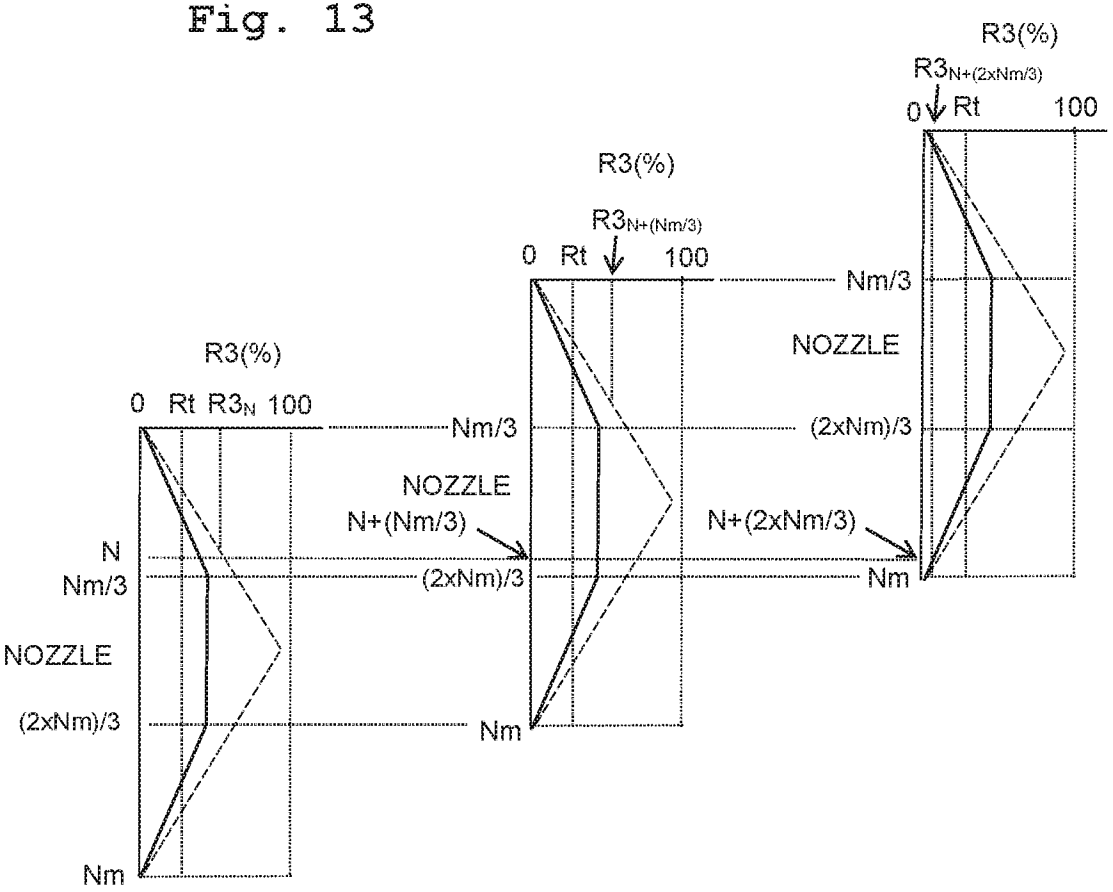
FIG. 13 illustrates a dot recording ratio for each nozzle in the second mask data according to the second modified embodiment.

In the second modified embodiment, the first mask data and the second mask data are saved in the flash memory 84. The first mask data is mask data that is similar to the first mask data W1 of the above embodiment and is used to record one line image by two continuous recording passes. The second mask data is mask data used to record one line image by three continuous recording passes. For example, FIG. 13 depicts dot recording ratios R3 for the nozzles 10.

Specifically, among the nozzles 10 of the ink-jet head 4, a nozzle 10 disposed at more downstream side in the conveyance direction included in one-third of the nozzles 10 disposed at the upstream side in the conveyance direction has a larger dot recording ratio R3. Among the nozzles 10 of the ink-jet head 4, one-third of the nozzles 10 disposed at the center portion in the conveyance direction has a substantially constant dot recording ratio R3. Among the nozzles 10 of the ink-jet head 4, a nozzle 10 disposed at more downstream side in the conveyance direction included in one-third of the nozzles 10 disposed at the downstream side in the conveyance direction has a smaller dot recording ratio R3. An average value of the dot recording ratios R3 for the nozzles 10 is smaller than an average value of the dot recording ratios R1. In FIG. 13, for comparison, the dot recording ratios R1 for the nozzles 10 in the first mask data W1 are indicated by broken lines.

In that case, N-th nozzle 10 (N=1, 2, . . . , (Nm/3)) from the upstream side in the conveyance direction, [N+(Nm/3)]-th nozzle 10 from the upstream side in the conveyance direction, and [N+(2×Nm/3)]-th nozzle 10 from the upstream side in the conveyance direction correspond to the same line image. Thus, the sum of a dot recording ratio $R3_N$ for N-th nozzle 10 (N=1, 2, . . . , (Nm/3)) from the upstream side in the conveyance direction, a dot recording ratio $R3_{N+(Nm/3)}$ for [N+(Nm/3)]-th nozzle 10 from the upstream side in the conveyance direction, and a dot recording ratio $R3_{N+(2\times Nm/3)}$ for [N+(2×Nm/3)]-th nozzle 10 from the upstream side in the conveyance direction is 100%.

Figure 14:
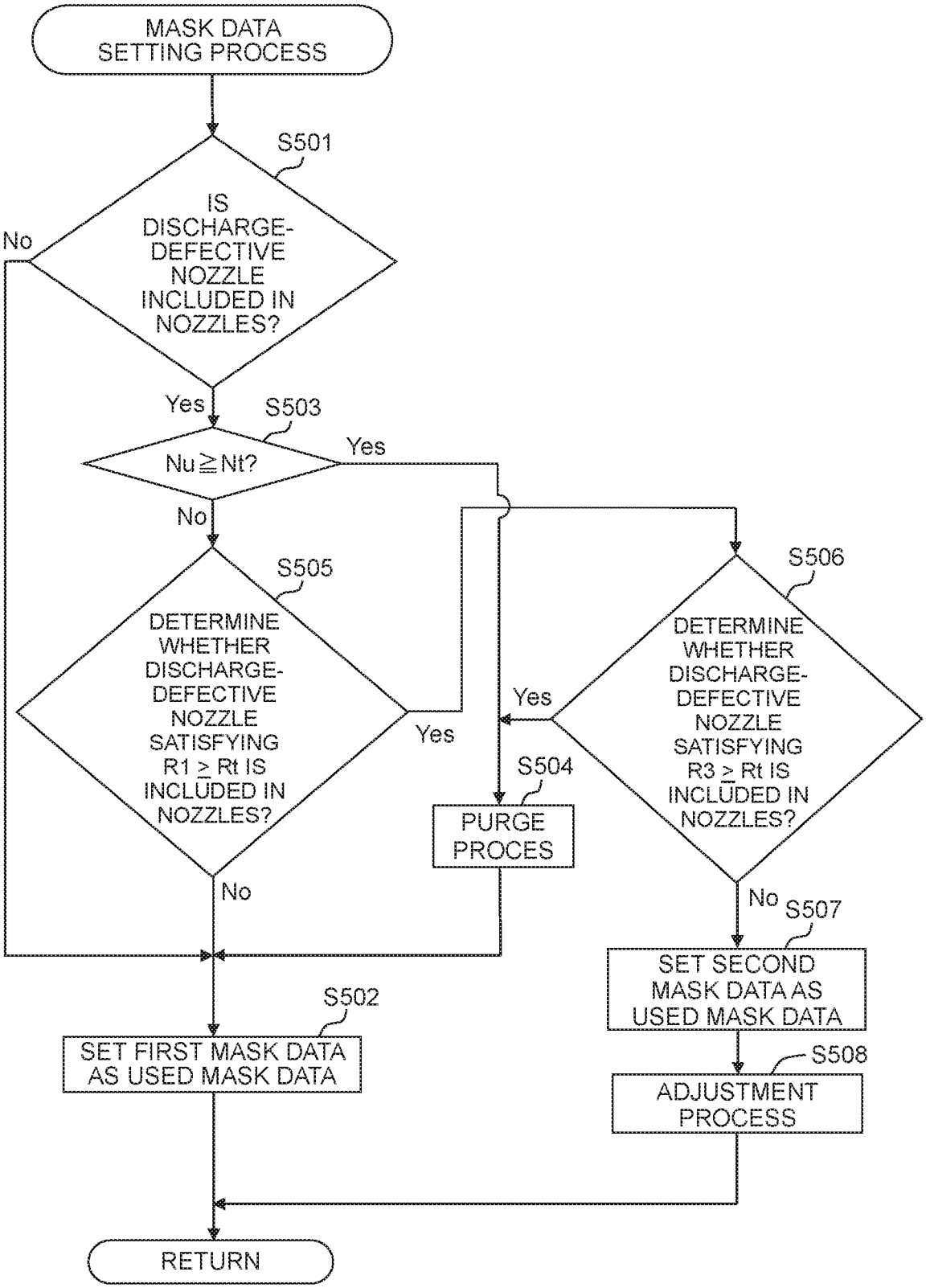
FIG. 14 is a flowchart indicating a mask data setting process according to the second modified embodiment.

In the mask data setting process of the second modified embodiment, the controller 80 performs processes in accordance with a flowchart of FIG. 14 to set the mask data used to perform image recording by the multi-pass recording mode.

More specifically, in the mask data setting process of the second modified embodiment, when the discharge-defective nozzle is not included in the nozzles 10 (S501: NO), the controller 80 sets the first mask data as the used mask data (S502) similar to the above embodiment. When the discharge-defective nozzle is included in the nozzles 10 (S501: YES) and when the number of discharge-defective nozzles Nu is equal to or more than the predefined value Nt (S503: YES), the controller 80 performs the purge process (S504), and sets the first mask data as the used mask data (S502). When the discharge-defective nozzle is included in the nozzles 10 (S501: YES), when the number of discharge-defective nozzles Nu is less than the predefined value Nt (S503: NO), and when the dot recording ratios R1 for all the discharge-defective nozzles are less than the threshold value Rt (S505: NO), the controller 80 sets the first mask data as the used mask data (S502).

When the discharge-defective nozzle is included in the nozzles 10 (S501: YES), when the number of discharge-defective nozzles Nu is less than the predefined value Nt (S503: NO), and when the discharge-defective nozzle of which dot recording ratio R1 is equal to or more than the threshold value Rt is included in the nozzles 10 (S505: YES), the controller 80 determines whether the discharge-defective nozzle of which dot recording ratio R3 is equal to or more than the threshold value Rt is included in the nozzles 10 when part of the line image is thinned out based on the second mask data (S506).

When the dot recording ratios R3 for all the discharge-defective nozzles are less than the threshold value (S506: NO), the controller 80 sets the second mask data as the used mask data (S507) and performs an adjustment process (S508). In the adjustment process, the controller 80 changes the conveyance amount of the recording sheet P in the conveyance operation from [L/2] to [L/3], and changes, in accordance with this change, the allocation of dots forming the image to be recorded to the respective nozzles 10. After this adjustment, one line image is recorded by three continuous recording passes by the multi-pass recording mode.

When the dot recording ratio R3 for any of the discharge-defective nozzles is equal to or more than the threshold value (S506: YES), the controller 80 performs the purge process (S504) and sets the first mask data as the used mask data (S502).

When image recording is performed using the multi-pass recording mode, the number of times of recording passes for recording the line image may increase. In this case, the average value of the dot recording ratios for the nozzles 10 in the recording passes decreases. This allows the mask data in which the dot recording ratio for the discharge-defective nozzle is less than the threshold value to be used as the second mask data.

In the second modified embodiment, when part of the line image is thinned out based on the second mask data, the line image is recorded by performing the recording passes one more time than a case in which part of the line image is thinned out based on the first mask data. The present disclosure, however, is not limited to such an aspect. When part of the line image is thinned out based on the second mask data, the line image may be recorded by performing the recording passes two more times than the case in which part of the line image is thinned out based on the first mask data. The time required for image recording is longer as the number of times of the recording passes for recording the line image increases. However, it is possible to reduce the average value of the dot recording ratios for the nozzles 10 in the recording passes.

In the above embodiment, the controller 80 determines whether the dot recording ratio R for the discharge-defective nozzle is equal to or more than the threshold value Rt irrespectively of which color of ink is discharged from the discharge-defective nozzle. Then, based on the determination, the controller 80 determines whether image recording is performed on the recording sheet P after performing the suction purge or whether image recording is performed on the recording sheet P without performing the suction purge. The present disclosure, however, is not limited to such an aspect.

For example, in the third modified embodiment, as depicted in FIG. 15, when the nozzle 10 (a first nozzle of the present disclosure) from which an ink of any other color than yellow (black, cyan, or magenta ink, a first ink of the present disclosure) is discharged, is the discharge-defective nozzle, the threshold value Rt is set as a threshold value Rt1 (a first threshold value of the present disclosure). When the nozzle 10 (a second nozzle of the present disclosure) from which yellow ink (a second ink of the present disclosure) is discharged, is the discharge-defective nozzle, the threshold value Rt is set as a threshold value Rt2 (a second threshold value of the present disclosure) that is larger than the threshold value Rt1. In the third modified embodiment, a table, as depicted in FIG. 15, in which the ink colors are associated with the threshold values Rt is saved in the flash memory 84 or the like.

The yellow ink has a paler or lighter color than the black, cyan, and magenta inks. Thus, even when the yellow ink is not discharged, the effect on the image quality of an image to be recorded is small. In view of the above, in the first modified embodiment, when the nozzle 10 from which an ink of any other color than yellow is discharged is the discharge-defective nozzle, the threshold value Rt is set to the threshold value Rt1. When the nozzle 10 from which the yellow ink is discharged is the discharge-defective nozzle, the threshold value Rt is set to the threshold value Rt2 that is larger than the threshold value Rt1. In that configuration, when the nozzle 10 from which the yellow ink of which color is pale is discharged is the discharge-defective nozzle, image recording is performed on the recording sheet p without the suction purge even when the dot recording ratio R for the discharge-defective nozzle is slightly large. Accordingly, the image to be recorded can have a good image quality and the time after the recording instruction is input until the image recording is completed is shortened.

In the first modified embodiment, the threshold value Rt varies depending on whether the nozzle 10 from which an ink of any other color than yellow is discharged is discharge-defective nozzle or whether the nozzle 10 from which the yellow ink is discharged is the discharge-defective nozzle. The present disclosure, however, is not limited to such an aspect. The threshold value Rt may vary depending on whether the first nozzle from which the first ink having a certain color is discharged is the discharge-defective nozzle or whether the second nozzle from which the second ink having a paler or lighter color than the first ink is discharged is the discharge-defective nozzle. The pale color means, for example, a color having a low density. The density is an index represented by a common logarithm [log (1/X)] of a reciprocal (1/X) of a ratio X of an amount of reflected light to an amount of irradiated light.

In the above embodiment, when the number of the discharge-defective nozzles Nu is equal or more than the predefined value Nt, image recording is performed on the recording sheet P after the suction purge, irrespective of the dot recording ratios R1 and R2 for the discharge-defective nozzles. The present disclosure, however, is not limited to such an aspect. For example, in the above embodiment, the determination in S205 and S207 may be performed irrespective of the number of the discharge-defective nozzles, and mask data may be set based on these results.

In the above embodiment, the printer 1 is capable of performing image recording on the recording sheet P by selectively using any of the single pass recording mode and the multi-pass recording mode. When image recording is performed on the recording sheet P by the single pass recording mode, and when the nozzles 10 include the discharge-defective nozzle, image recording is performed on the recording sheet P after the suction purge. The present disclosure, however, is not limited to such an aspect. For example, a printer capable of performing image recording on the recording sheet P only by the multi-pass recording mode may be used.

In the above embodiment, when the nozzles 10 include the discharge-defective nozzle, and when the next recording instruction is not input after image recording is performed on the recording sheet P by the multi-pass recording mode without the suction purge until the predefined time elapses, the suction purge is performed and the series of processes is ended. The present disclosure, however, is not limited to such an aspect. For example, when the nozzles 10 include the discharge-defective nozzle, and when image recording is performed on the recording sheet P by the multi-pass recording mode without the suction purge, the series of processes may be ended after the suction purge is performed immediately after the image recording is completed.

Or, when the nozzles 10 include the discharge-defective nozzle, and when image recording is performed on the recording sheet P by the multi-pass recording mode without performing the suction purge, the series of processes may be ended without the suction purge after the image recording is completed.

In the above embodiment, the inks in the ink-jet head 4 are discharged from the nozzles 10 through the suction purge. The present disclosure, however, is not limited to such an aspect.

Figure 16:
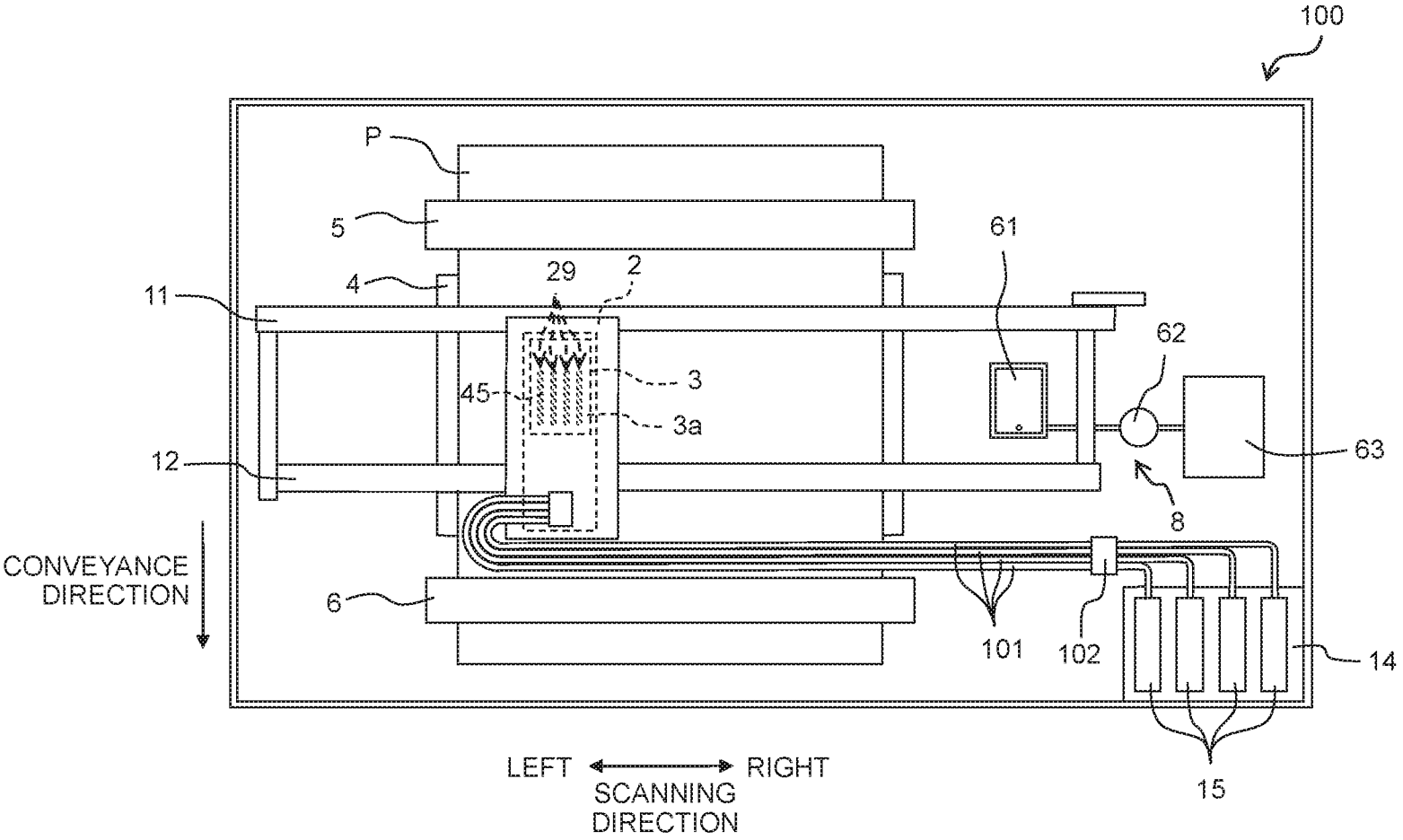
FIG. 16 schematically depicts a printer according to the fourth modified embodiment.

For example, in a printer 100 of the fourth modified embodiment depicted in FIG. 16, a pressurization pump 102 is provided in tubes 101 connecting the subtank 3 and four ink cartridges.

Thus, in the printer 100, a pressurizing purge can be performed by driving the pressurization pump 102 in a state where the nozzles 10 are covered with the cap 61. In the pressurizing purge, the inks in the ink-jet head 4 are discharged from the nozzles 10 by pressurizing the inks in the tubes 101, the sub tank 3, and the ink-jet head 4. In the fourth modified embodiment, the controller 80 controls the pressurization pump 102 and the cap 61 to perform the pressurizing purge (the discharge operation of the present disclosure) in the purge process of S104, S109, and S113. In the fourth modified embodiment, a combination of the pressurization pump 102 and the cap 61 corresponds to a discharge mechanism of the present disclosure. In the fourth modified embodiment, the suction pump 102 may not be provided, and the cap 61 may be connected directly to the waste liquid tank 63.

In the fourth modified embodiment, the pressurization pump 102 is provided in the tubes 101. The present disclosure, however, is not limited to such an aspect. For example, the printer may include a pressurization pump connected to the ink cartridges 15.

Figure 17A:
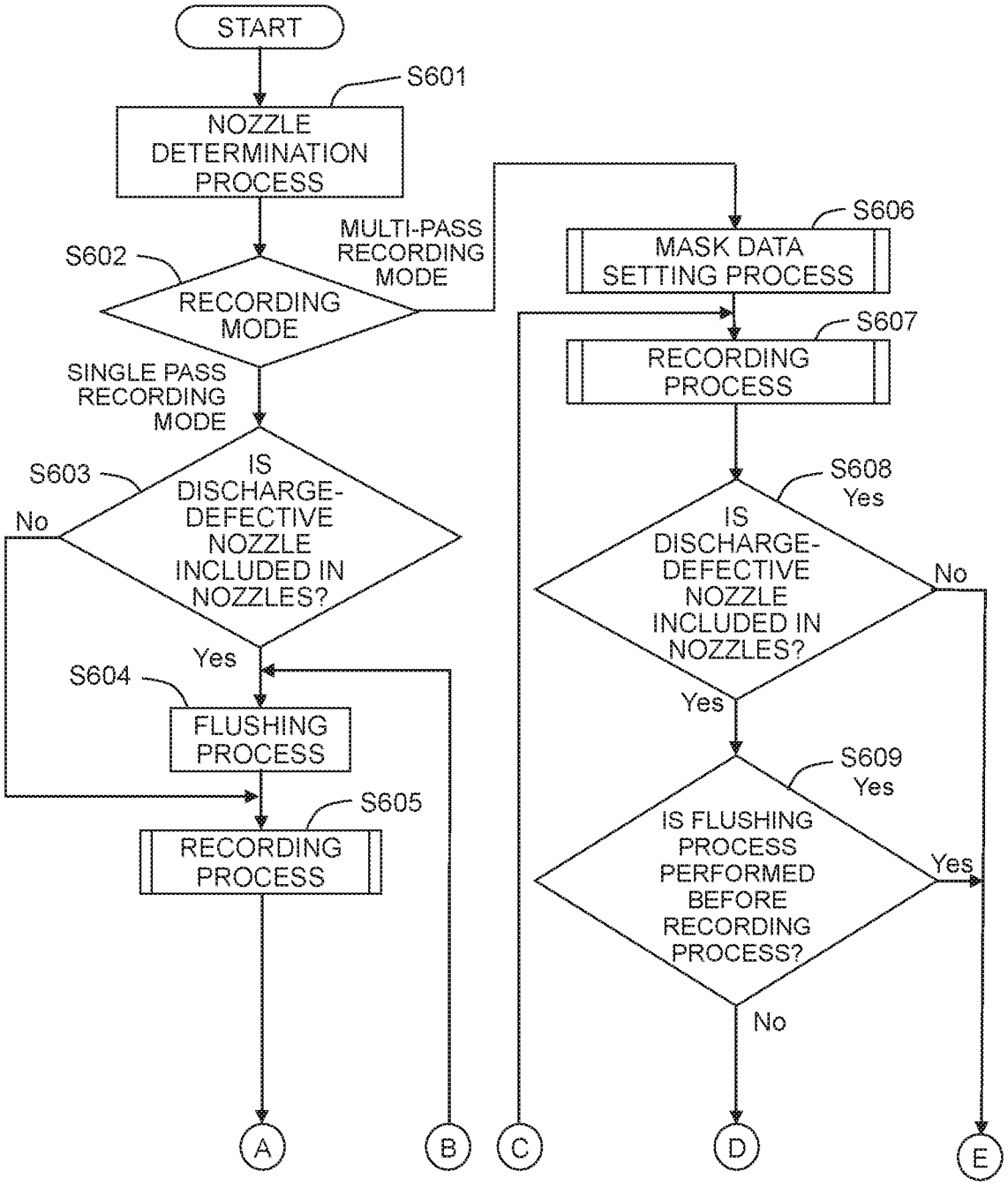
FIGS. 17A and 17B depict a flowchart indicating processes in recording according to the fifth modified embodiment.
Figure 17B:
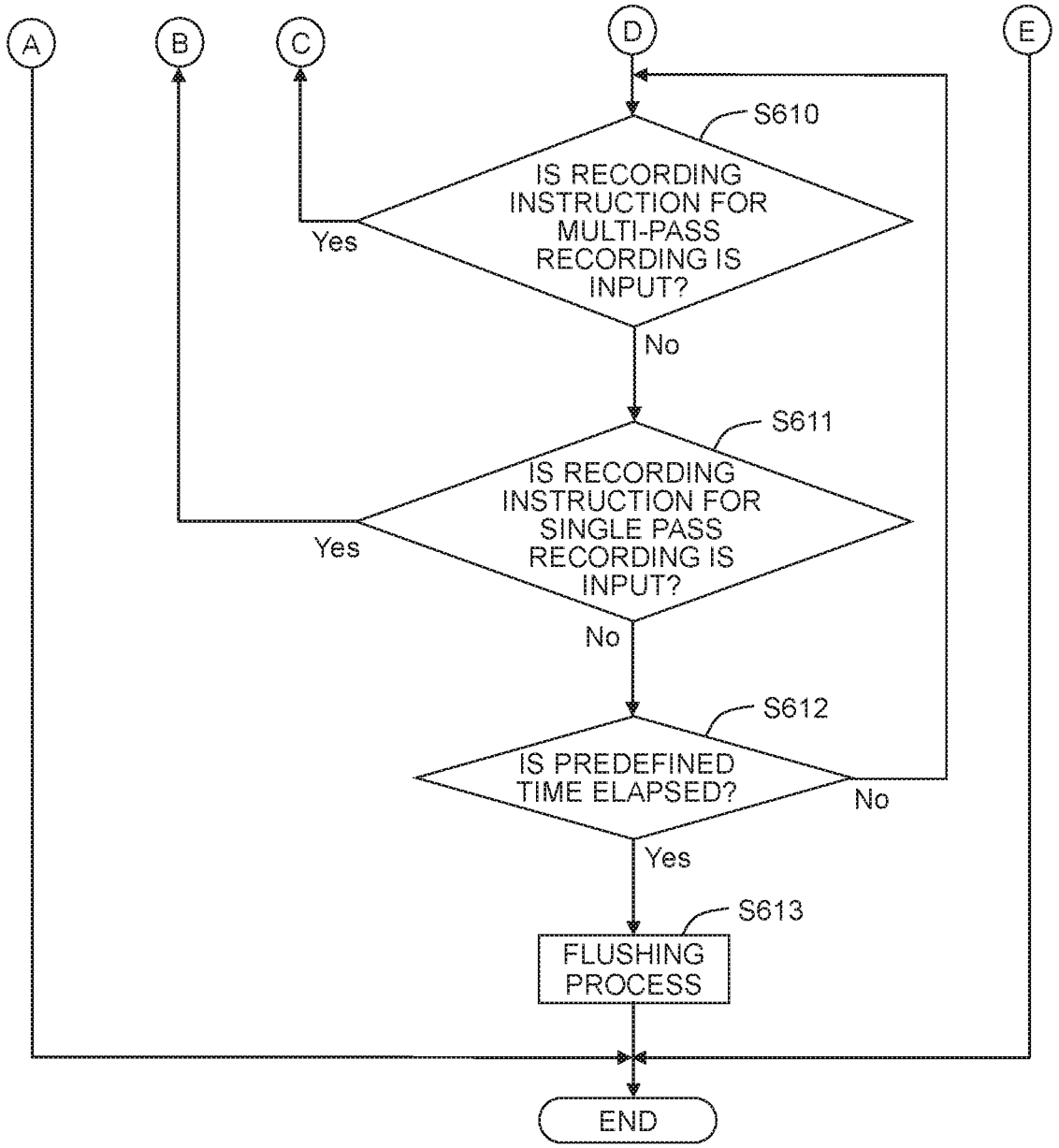

In the fifth modified embodiment, as indicated in FIG. 17, when image recording is performed on the recording sheet P by the single pass recording mode (S602: single pass recording mode), and when the discharge-defective nozzle is included in the nozzles 10 (S603: YES), the controller 80 performs a flushing process (S604). In the flushing process, the controller 80 performs flushing (the discharge operation of the present disclosure) by driving the driving element 50 corresponding to the discharge-defective nozzle of the piezoelectric actuator 22 to discharge ink from the discharge-defective nozzle. In this situation, the electrical potential applied to the individual electrode 54 may be higher than that at the time of image recording.

Figure 18:
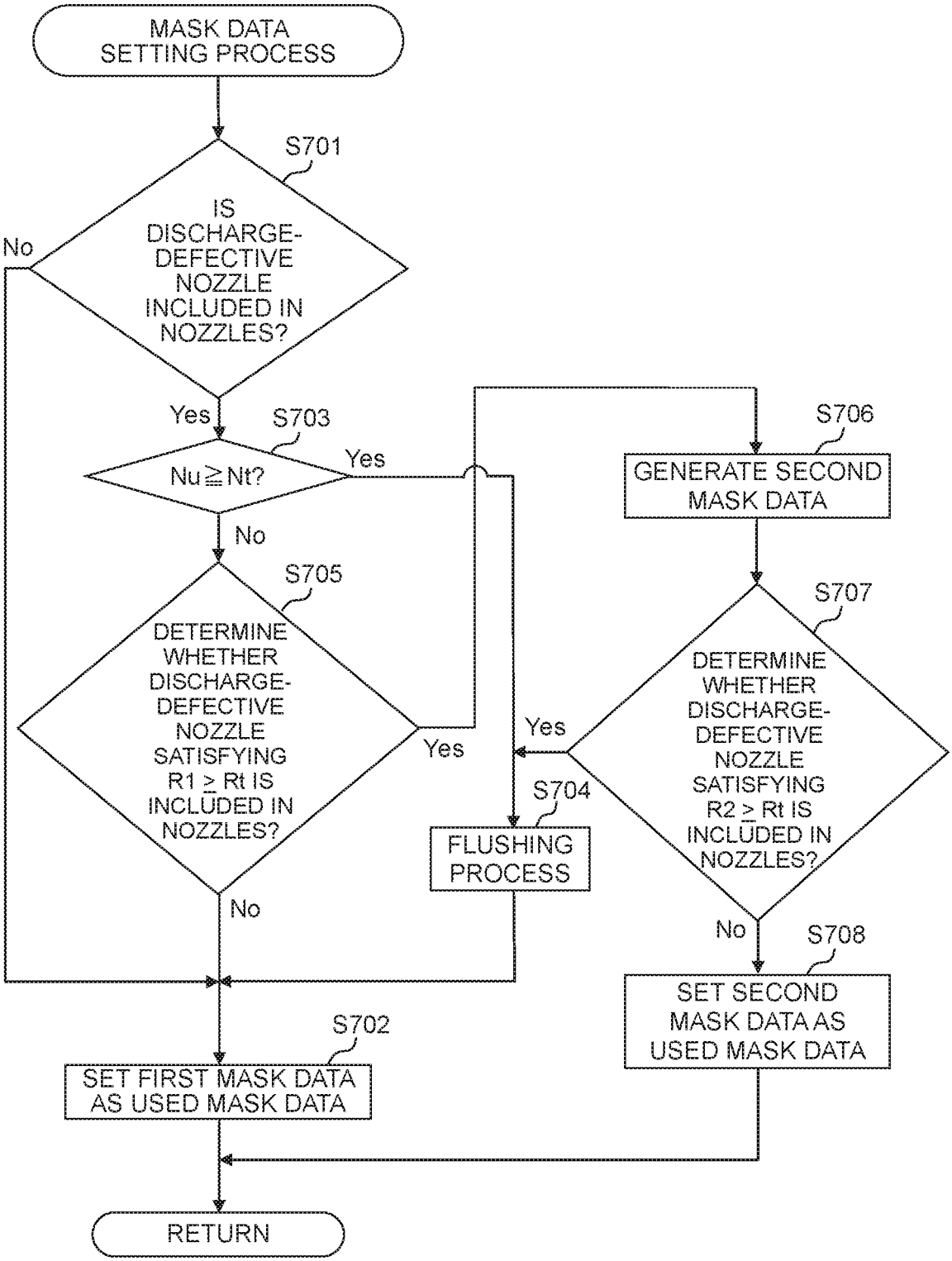
FIG. 18 is a flowchart indicating a mask data setting process according to the fifth modified embodiment.

In the mask data setting process indicated in FIG. 18, when the discharge-defective nozzle is included in the nozzles 10 (S701: YES), and when the number of discharge-defective nozzles Nu is equal to or more than the predefined value Nt (S703: YES), the controller 80 performs the flushing process (S704) similar to S604. When the dot recording ratio R2 for at least one discharge-defective nozzle is less than the threshold value Rt (S707: YES) by thinning out part of the line image based on the second mask data, the controller 80 performs the flushing process (S704) similar to S604.

As indicated in FIG. 17, after image recording is performed on the recording sheet P by the multi-pass recording mode (after S607), when the controller 80 has determined in S701 that the nozzles 10 include the discharge-defective nozzle (S608: YES), when the flushing of S704 is not performed before the image recording (S609: NO), and when the next recording instruction is not input until the predefined time elapses (S601: NO, S611: NO, S612: YES), the controller 80 performs the flushing process (S613) similar to S604.

In the fifth modified embodiment, the driving element 50 performing the flushing corresponds to the discharge mechanism of the present disclosure. Further, in the fifth modified embodiment, the processes in S603, S612, S703, and S707 different from those as described above are similar to S103, S112, S203, and S207, respectively. Furthermore, the processes in S601, S602, S605, and S607 to 611 of the fifth modified embodiment are similar to S101, S102, S105, and S107 to S111 of the above embodiment, respectively. Moreover, the processes in S701 to S703 and 5705 to S708 in the fifth modified embodiment are similar to the processes S201 to S203 and S205 to S208 in the above embodiment.

As the discharge operation, two or more of the suction purge, the pressurizing purge, and the flushing may be performed. When the discharge operation includes the suction purge, the discharge mechanism of the present disclosure includes the maintenance unit 8. When the discharge operation includes the pressurizing purge, the discharge mechanism of the present disclosure includes the cap 61 and the pressurization pump 102. When the discharge operation includes the flushing, the discharge mechanism of the present disclosure includes the driving element 50. When the discharge operation includes the suction purge and the pressuring purge, the suction by the suction pump 62 and the pressurization by the pressurization pump may be performed separately or simultaneously.

In the above embodiment, when the dot recording ratio R1 for the discharge-defective nozzle is less than the threshold value Rt by thinning out the line image based on the first mask data W1, the first mask data W1 is set as the used mask data and recording is performed without the discharge operation (suction purge). When the dot recording ratio R1 for the discharge-defective nozzle is equal to or more than the threshold value Rt by thinning out the line image based on the first mask data W1, and when the dot recording ration R2 for the discharge-defective nozzle is less than the threshold value Rt by thinning out the line image based on the second mask data W2, the second mask data W2 is used as the used mask data and recording is performed without the discharge operation (suction purge). The present disclosure, however, is not limited to such an aspect.

For example, when the dot recording ratio R1 for the discharge-defective nozzle is less than the threshold value Rt by thinning out the line image based on the first mask data W1, the first mask data W1 may be set as the used mask data and recording may be performed after the flushing is performed as the discharge operation. When the dot recording ratio R1 for the discharge-defective nozzle is equal to or more than the threshold value Rt by thinning out the line image based on the first mask data W1, and when the dot recording ratio R2 for the discharge-defective nozzle is less than the threshold value Rt by thinning out the line image based on the second mask data W2, the second mask data W2 may be set as the used mask data and recording may be performed after the flushing is performed as the discharge operation.

In the above embodiment, whether or not the nozzle 10 is the discharge-defective nozzle is determined by using the voltage value of the detection electrode 66 when ink is discharged from the nozzle 10 to the detection electrode 66. The present disclosure, however, is not limited to such an aspect.

For example, a detection electrode extending in the up-down direction may be provided in the printer, and whether the nozzle 10 is the discharge-defective nozzle may be determined using a voltage value of the detection electrode when the ink discharged from the nozzle 10 passes through an area facing the detection electrode. Or, an optical sensor that detects the ink discharged from the nozzle 10 may be provided in the printer, and whether the nozzle 10 is the discharge-defective nozzle may be determined based on a detection result of the optical sensor.

Or, for example, slimier to the description of Japanese Patent No. 4,929,699, a voltage detection circuit (the signal output circuit of the present disclosure) that detects a change in voltage when ink is discharged from the nozzle may be connected to a plate on which the nozzles of the ink-jet head are formed, and a signal that varies depending on whether or not the nozzle 10 is the discharge-defective nozzle may be output from the voltage detection circuit to the controller 80.

Or, for example, slimier to the description of Japanese Patent No. 6,231,759, a temperature detection element may be provided in a substrate of the ink-jet head. In that configuration, a heater may be driven by applying a first application voltage to discharge ink, and the heater may be driven by applying a second application voltage not to discharge ink. Then, whether ink is discharged properly or normally may be determined based on a temperature change detected by the temperature detection element after the second application voltage is applied until a predefined time elapses.

In the above embodiment, when ink is not discharged from a certain nozzle 10 included in the nozzles 10, the certain nozzle 10 is determined as the discharge-defective nozzle. The present disclosure, however, is not limited to such an aspect. For example, the controller 80 may determine whether the nozzle 10 is the discharge-defective nozzle based on whether the flying speed of ink discharged from the nozzle 10 is within a predefined speed, whether ink discharged from the nozzle 10 has landed on a predefined landing position, whether a desired amount of ink is discharged from the nozzle 10, or the like.

In the above embodiment, when image recording is performed using the multi-pass recording mode, part of the line image is thinned out based on the same mask data in all the recording passes for recording an image on one recording sheet P. The present disclosure, however, is not limited to such an aspect. For example, when one recording sheet P includes areas for which images are to be recorded and blank spaces between the areas in the conveyance direction, different mask data may be used in the recording passes for the areas where the images are to be recorded.

In the above embodiment, the determination whether the nozzle 10 is the discharge-defective nozzle is performed for each of the nozzles 10 based on the signal from the determination circuit 68. The present disclosure, however, is not limited to such an aspect. For example, the determination whether the nozzle 10 is the discharge-defective nozzle may be performed for some of the nozzles 10 based on the signal from the determination circuit 68, and the controller may infer whether the remaining nozzles 10 are the discharge-defective nozzles based on the determination result of the some of the nozzles 10.

In the above embodiment, ink is discharged from the nozzle 10 when the driving element 50 applies pressure to the ink in the pressure chamber 40. The present disclosure, however, is not limited to such an aspect. For example, ink may be discharged from the nozzle by heating ink and generating bubbles in the ink channel(s).

In the above embodiment, the recording sheet P is conveyed by the conveyance rollers 6 and 7. The present disclosure, however, is not limited to such an aspect. For example, the recording sheet P may be conveyed by a conveyance belt. In this case, the conveyance belt corresponds to the conveyer of the present disclosure. Or, the medium may be conveyed by providing a movable table by use of a ball screw or the like and moving the table with the medium placed on the table. In this case, the table that is movable through the ball screw or the like corresponds to the conveyer of the present disclosure.

The examples in which the present disclosure is applied to the printer that discharges ink from nozzles to perform recording on a recording sheet P are explained above. The present disclosure, however, is not limited thereto. The present disclosure is applicable to an image recording apparatus that performs image recording on any other recording medium than the recording sheet, such as a T-shirt, a sheet for out-of-home advertising, a case of a mobile terminal including a smartphone, cardboard, and a resin member.

What is claimed is:

1. An image recording apparatus, comprising:

a conveyer configured to convey a medium in a conveyance direction;

a recording head including a plurality of nozzles arranged in the conveyance direction;

a carriage configured to move the recording head in a scanning direction intersecting with the conveyance direction;

a signal output circuit configured to output a signal that varies depending on whether at least part of the nozzles is a discharge-defective nozzle of which discharge performance is lower than a predefined discharge performance; and a controller configured to:

set at least one nozzle included in the nozzles as a target nozzle, and determine whether the discharge-defective nozzle is included in the at least one target nozzle based on the signal from the signal output circuit;

control the image recording apparatus to perform image recording on the medium by causing the image recording apparatus to perform a plurality of recording passes in each of which a liquid is discharged from the nozzles to the medium during movement in the scanning direction of the carriage and a conveyance operation in which the medium is conveyed in the conveyance direction by the conveyer; and control the image recording apparatus to perform image recording by a multi-pass recording mode in which a thinned-out image is recorded by conveying the medium in the conveyance operation such that a plurality of recording areas on the medium for which an image is to be recorded by the recording passes performed continuously partially overlap with each other, and by recording a line image corresponding to one line in the scanning direction in an overlapping area, where the recording areas overlap with each other, in the recording passes performed continuously by use of nozzles different from each other so that different parts of the line image are thinned out based on mask data, wherein in a case that the image recording is performed by the multi-pass recording mode, the controller is configured to:

thin out part of the line image based on first mask data as the mask data in the recording passes performed continuously;

in a case that the controller has determined that the discharge-defective nozzle is included in the at least one target nozzle, and in a case that a dot recording ratio that is a ratio of the number of dots of the thinned-out image to be recorded by the discharge-defective nozzle to the number of dots of an entirety of the line image is equal to or more than a threshold value by thinning out the part of the line image based on the first mask data, thin out the part of the line image based on second mask data as the mask data in the recording passes performed continuously, instead of thinning out the part of the line image based on the first mask data, the second mask data being data in which the dot recording ratio for the thinned-out image to be recorded by the discharge-defective nozzle is less than the threshold value.

2. The image recording apparatus according to claim 1, wherein in the case that the image recording is performed on the medium, the controller is configured to control the recording head, the conveyer, and the carriage to alternatingly perform each of the recording passes and the conveyance operation.

3. The image recording apparatus according to claim 1, wherein the predefined discharge performance is one of a discharge performance as to whether a liquid droplet having a predefined size is discharged from the nozzles, a discharge performance as to whether the liquid droplet is discharged at a predefined velocity, and a discharge performance as to whether the liquid droplet is discharged in a predefined direction.

4. The image recording apparatus according to claim 1, wherein in the case that the image recording is performed by the multi-pass recording mode, the controller is configured to:

thin out the part of the line image based on the first mask data in all the recording passes by which the image recording is performed on one medium; and in the case that the controller has determined that the discharge-defective nozzle is included in the nozzles, and that the dot recording ratio for the thinned-out image to be recorded by the discharge-defective nozzle is equal to or more than the threshold value by thinning out the part of the line image based on the first mask data, thin out the part of the line image based on the second mask data in all the recording passes by which the image recording is performed on the one medium, instead of thinning out the part of the line image based on the first mask data.

5. The image recording apparatus according to claim 1, wherein the signal output circuit is configured to output a signal indicating that at least a nozzle included in the nozzles and from which the liquid is not discharged is the discharge-defective nozzle.

6. The image recording apparatus according to claim 1, wherein in the case that (1) the image recording is performed by the multi-pass recording mode, that (2) the controller has determined that the discharge-defective nozzle is included in the at least one target nozzle, and that (3) the dot recording ratio for the thinned-out image to be recorded by the discharge-defective nozzle is equal to or more than the threshold value by thinning out the part of the line image based on the first mask data, the controller is configured to control the image recording apparatus to record the line image by the recording passes performed continuously the same number of times as a case in which the controller has determined that the discharge-defective nozzle is excluded in the at least one target nozzle, and the second mask data is mask data of which a dot recording ratio for the thinned-out image to be recorded by a nozzle that is used to record the same line image as the discharge-defective nozzle and that is not the discharge-defective nozzle is larger than that of the first mask data.

7. The image recording apparatus according to claim 6, wherein in the case that the image recording is performed by the multi-pass recording mode, the controller is configured to record the line image by two recording passes included in the recording passes performed continuously, and a relation $R2_N$ [%]=(100−$R1_N$) [%] is satisfied, wherein N is set to a natural number, wherein the dot recording ratio for the thinned-out image to be recorded by N-th nozzle from an upstream side in the conveyance direction in the case that the part of the line image is thinned out based on the first mask data, is set to $R1_N$ [%], and wherein the dot recording ratio for the thinned-out image to be recorded by the N-th nozzle from the upstream side in the conveyance direction in the case that the part of the line image is thinned out based on the second mask data, is set to $R2_N$[%].

8. The image recording apparatus according to claim 1, wherein in the case that (1) the image recording is performed by the multi-pass recording mode, that (2) the controller has determined that the discharge-defective nozzle is included in the nozzles, and that (3) the dot recording ratio for the thinned-out image to be recorded by the discharge-defective nozzle is equal to or more than the threshold value by thinning out the part of the line image based on the first mask data, the controller is configured to make the number of times of the recording passes performed continuously by which the line image is recorded larger than a case in which the controller has determined that the discharge-defective nozzle is excluded in the nozzles, and the second mask data is mask data in which an average value of dot recording ratios for the thinned-out image to be recorded by the nozzles is smaller than that of the first mask data.

9. The image recording apparatus according to claim 1, further comprising a memory configured to save a plurality of kinds of the mask data, wherein in the case that (1) the image recording is performed by the multi-pass recording mode, that (2) the controller has determined that the discharge-defective nozzle is included in the at least one target nozzle, and that (3) the dot recording ratio for the thinned-out image to be recorded by the discharge-defective nozzle is equal to or more than the threshold value by thinning out the part of the line image based on the first mask data included in the plurality of kinds of mask data, the controller is configured to set, as the second mask data, mask data other than the first mask data included in the plurality of kinds of mask data, of which dot recording ratios for the thinned-out image to be recorded by all the discharge-defective nozzles are less than the threshold value.

10. The image recording apparatus according to claim 1, further comprising a discharge mechanism configured to perform a discharge operation in which the liquid in the recording head is discharged from the nozzles, wherein in the case that the image recording is performed by the multi-pass recording mode, and that the part of the line image is thinned out based on the second mask data, the controller is configured to control the image recording apparatus to perform the image recording on the medium without the discharge operation by the discharge mechanism.

11. The image recording apparatus according to claim 10, wherein in the case that the image recording is performed by the multi-pass recording mode, and that the controller has determined that the discharge-defective nozzle is included in the at least one target nozzle, the controller is configured to generate the second mask data based on a position in the conveyance direction of the discharge-defective nozzle, and in a case that the dot recording ratios for the thinned-out image to be recorded by all the discharge-defective nozzles are less than the threshold value, the controller is configured to control the image recording apparatus to perform the image recording after the discharge operation by the discharge mechanism.

12. The image recording apparatus according to claim 9, further comprising a discharge mechanism configured to perform a discharge operation in which the liquid in the recording head is discharged from the nozzles, wherein in the case that the image recording is performed by the multi-pass recording mode, and that the part of the line image is thinned out based on the second mask data, the controller is configured to control the image recording apparatus to perform image recording on the medium without the discharge operation by the discharge mechanism, and wherein in a case that the image recording is performed by the multi-pass recording mode, and that mask data, in which the dot recording ratios for the thinned-out image to be recorded by all the discharge defective nozzles are less than the threshold value, is excluded in the plurality of kinds of mask data, the controller is configured to control the image recording apparatus to perform the image recording after the discharge operation by the discharge mechanism.

13. The image recording apparatus according to claim 10, wherein in the case that the controller has determined that the discharge-defective nozzle is included in the at least one target nozzle, and that the controller controls the image recording apparatus to perform the image recording on the medium by the multi-pass recording mode without the discharge operation by the discharge mechanism, the discharge mechanism is configured to perform the discharge operation after the image recording is completed.

14. The image recording apparatus according to claim 13, wherein in the case that (1) the controller has determined that the discharge-defective nozzle is included in the at least one target nozzle, that (2) the controller controls the image recording apparatus to perform the image recording on the medium by the multi-pass recording mode without the discharge operation by the discharge mechanism, and that (3) a recording instruction is not input after the image recording is completed until a predefined time elapses, the discharge mechanism is configured to perform the discharge operation, and in a case that (1) the controller has determined that the discharge-defective nozzle is included in the at least one target nozzle, that (2) the controller controls the image recording apparatus to perform the image recording on the medium by the multi-pass recording mode without the discharge operation by the discharge mechanism, and that (3) a recording instruction for instructing the image recording apparatus to perform image recording by the multi-pass recording mode is input after the image recording is completed until the predefined time elapses, the controller is configured to control the image recording apparatus to perform the image recording on the medium based on the recording instruction without the discharge operation by the discharge mechanism.

15. The image recording apparatus according to claim 10, wherein in the case that the controller has determined that the discharge-defective nozzle is included in the at least one target nozzle, the controller is configured to obtain information about the number of the discharge-defective nozzles based on the signal from the signal output circuit, and in a case that the controller has determined that the discharge-defective nozzle is included in the at least one target nozzle, and that the number of the discharge-defective nozzles exceeds a predefined value, the controller is configured to control the image recording apparatus to perform the image recording after the discharge operation by the discharge mechanism, even in a case that any other condition for performing image recording without the discharge operation is satisfied.

16. The image recording apparatus according to claim 10, wherein the nozzles are arranged in the conveyance direction to have a predefined length, wherein the controller is configured to control the image recording apparatus to perform the image recording by selectively using the multi-pass recording mode and a single pass recording mode in which the medium is conveyed in the conveyance direction by the predefined length and the line image is recorded by the recording pass performed once, and wherein in a case that the image recording is performed by the single pass recording mode and that the controller has determined that the discharge-defective nozzle is included in the at least one target nozzle, the controller is configured to control the image recording apparatus to perform the image recording on the medium after the discharge operation by the discharge mechanism.

17. The image recording apparatus according to claim 10, wherein in the case that the image recording is performed by the multi-pass recording mode, and that the controller has determined that the discharge-defective nozzle is included in the at least one target nozzle, and that the dot recording ratio for the thinned-out image to be recorded by the discharge-defective nozzle is less than the threshold value by thinning out the part of the line image based on the first mask data, the controller is configured to thin out the part of the line image based on the first mask data in the recording passes performed continuously and to control the image recording apparatus to perform the image recording on the medium without the discharge operation by the discharge mechanism.

18. The image recording apparatus according to claim 10, wherein the discharge mechanism includes a cap configured to cover the nozzles and a suction pump connected to the cap.

19. The image recording apparatus according to claim 10, wherein the discharge mechanism includes a pressurization pump configured to pressurize the liquid in the recording head.

20. The image recording apparatus according to claim 10, wherein the recording head includes a plurality of pressure chambers communicating with the nozzles and a plurality of driving elements configured to apply pressure to the liquid in the pressure chambers, and the discharge mechanism includes the driving elements.

21. The image recording apparatus according to claim 1, wherein the nozzles include a plurality of first nozzles from which a first ink is discharged and a plurality of second nozzles from which a second ink having a paler or lighter color than the first ink is discharged, the controller is configured to set the threshold value to a first threshold value in a case that the discharge-defective nozzle is the first nozzle, and the controller is configured to set the threshold value to a second threshold value larger than the first threshold value in a case that the discharge-defective nozzle is the second nozzle.

22. The image recording apparatus according to claim 21, wherein the second ink is a yellow ink, and the first ink is an ink having any other color than the yellow ink.

* * * * *